US011166093B2

(12) United States Patent
Cohen et al.

(10) Patent No.: US 11,166,093 B2
(45) Date of Patent: Nov. 2, 2021

(54) EARPHONE DEVICE SUPPORT AND CASE

(71) Applicant: Logitech Europe S.A., Lausanne (CH)

(72) Inventors: Navi Cohen, San Jose, CA (US); Jose Froilan P Lomotan, San Jose, CA (US); Jonathan Thuot, Fremont, CA (US)

(73) Assignee: LOGITECH EUROPE S.A., Lausanne (CH)

( * ) Notice: Subject to any disclaimer, the term of this patent is extended or adjusted under 35 U.S.C. 154(b) by 0 days.

(21) Appl. No.: 16/692,959

(22) Filed: Nov. 22, 2019

(65) Prior Publication Data

US 2020/0304896 A1 Sep. 24, 2020

Related U.S. Application Data

(60) Provisional application No. 62/820,793, filed on Mar. 19, 2019.

(51) Int. Cl.
*H04R 1/10* (2006.01)

(52) U.S. Cl.
CPC ..... *H04R 1/1016* (2013.01); *H04R 1/1025* (2013.01); *H04R 1/1041* (2013.01); *H04R 2420/07* (2013.01)

(58) Field of Classification Search
CPC .. H04R 1/1016; H04R 1/1025; H04R 1/1041; H04R 2420/07; H04R 1/10; H04R 1/105;
(Continued)

(56) References Cited

U.S. PATENT DOCUMENTS 588,099 A 8/1897 Blount
931,768 A 8/1909 Kirkpatrick
(Continued)

FOREIGN PATENT DOCUMENTS

CN 208489960 U 2/2019
EP 2645736 A1 10/2013
WO 0150813 A2 7/2001

OTHER PUBLICATIONS

Chinese Office Action dated Aug. 23, 2021 for Application No. 202010183416.7.

*Primary Examiner* — Disler Paul
(74) *Attorney, Agent, or Firm* — Patterson & Sheridan, L.L.P.

(57) ABSTRACT

Embodiments described herein relate to earphone device supports and earphone support cases. In embodiments described herein, an earphone support is configured to be securely positioned over an earphone device. The earphone support includes a main body with a supporting element extending therefrom. The supporting element has a curvature shaped to follow a contour of the earphone device such that it clips onto to the earphone device. In additional embodiments described herein, an earphone support case is configured to securely store the earphone supports and mate with an earphone device case. The earphone support case has a main body coupled to a lid by a hinge. The main body includes a plurality of earphone support mounts. Each of the earphone support mounts are configured to support one of a plurality of earphone supports such that each earphone support is securely positioned within the earphone support case.

20 Claims, 20 Drawing Sheets

(58) Field of Classification Search
CPC ..... H04R 1/1075; H04R 25/60; H04R 25/65; H04R 1/025; H04R 1/021; H04R 9/06; H04R 2499/11; H04R 1/02; H04R 1/345
USPC ..... 381/74, 380–381, 386, 338, 328, 370, 381/322, 332, 324
See application file for complete search history.

(56) References Cited

U.S. PATENT DOCUMENTS 1,564,474 A 12/1925 Fensky
1,614,987 A 1/1927 Langbeck et al.
1,668,890 A 5/1928 Curran et al.
1,688,910 A 10/1928 Winship
1,753,817 A 4/1930 Aber
1,893,143 A 1/1933 Koch
1,969,559 A 8/1934 Kelly
2,353,070 A 7/1944 Pitkin, Jr.
2,437,490 A 3/1948 Watson
2,521,414 A 9/1950 Schier
2,545,731 A 3/1951 French
2,595,489 A 5/1952 Rutter et al.
2,763,334 A 9/1956 Starkey
2,908,343 A 10/1959 Hummert
2,910,980 A 11/1959 Stewart
3,000,462 A 9/1961 Smith
3,053,061 A 9/1962 French
3,157,245 A 11/1964 Bernstein
D221,442 S 8/1971 Feingold
4,010,820 A 3/1977 Johnson
4,055,233 A 10/1977 Huntress
4,219,018 A 8/1980 Draper, Jr.
D266,590 S 10/1982 Bennett
4,353,364 A 10/1982 Woods
4,403,120 A 9/1983 Yoshimi
4,429,194 A 1/1984 Kamon et al.
D274,814 S 7/1984 Tang
4,540,063 A 9/1985 Ochi et al.
4,646,872 A 3/1987 Kamon et al.
4,736,435 A 4/1988 Yokoyama et al.
4,864,610 A 9/1989 Stevens
4,896,679 A 1/1990 St. Pierre
4,965,838 A 10/1990 Kamon et al.
4,972,492 A 11/1990 Tanaka et al.
D316,550 S 4/1991 Sogabe
D318,670 S 7/1991 Taniguchi
5,048,090 A 9/1991 Geers
5,055,233 A 10/1991 Borland et al.
D326,655 S 6/1992 Iribe
5,222,151 A 6/1993 Nagayoshi et al.
5,247,946 A 9/1993 Holder
5,298,692 A 3/1994 Ikeda et al.
5,305,387 A 4/1994 Sapiejewski
5,548,643 A 8/1996 Dalgleish et al.
5,625,171 A 4/1997 Marshall
5,654,530 A 8/1997 Sauer et al.
5,668,354 A 9/1997 Falco
D388,093 S 12/1997 Frengley
5,712,453 A 1/1998 Bungardt et al.
5,727,566 A 3/1998 Leight
5,957,136 A 9/1999 Magidson et al.
D430,139 S 8/2000 Peters et al.
D430,547 S 9/2000 Yoon
D430,860 S 9/2000 Yoon
6,129,175 A 10/2000 Tutor et al.
6,176,576 B1 1/2001 Green et al.
6,241,041 B1 6/2001 Leight
6,449,374 B1 9/2002 Skulley et al.
D469,755 S 2/2003 Hlas et al.
D470,122 S 2/2003 Hlas et al.
D470,123 S 2/2003 Hlas et al.
D470,128 S 2/2003 Hlas et al.
D470,129 S 2/2003 Hlas et al.
D471,537 S 3/2003 Ham
D471,890 S 3/2003 Clarkson
D473,204 S 4/2003 Tanio
D478,991 S 8/2003 Dyer et al.
6,637,910 B1 10/2003 Mehler et al.
6,683,965 B1 1/2004 Sapiejewski
6,688,421 B2 2/2004 Dyer et al.
6,690,807 B1 2/2004 Meyer
6,695,093 B1 2/2004 Falco
6,795,718 B2 9/2004 Bae
6,819,762 B2 11/2004 Jones et al.
6,819,770 B2 11/2004 Niederdrank
6,820,717 B2 11/2004 Fleming et al.
6,868,284 B2 3/2005 Bae
6,879,697 B2 4/2005 Topholm
D505,132 S 5/2005 Linville et al.
6,944,307 B2 9/2005 Berg
D510,574 S 10/2005 Okada
6,961,440 B1 11/2005 Schlaegel
7,050,599 B2 5/2006 Baskerville
7,068,803 B2 6/2006 Kuhlmann et al.
D525,962 S 8/2006 Elson
D538,271 S 3/2007 Kim et al.
7,233,676 B2 6/2007 Bayer
D558,735 S 1/2008 Carr et al.
7,340,075 B2 3/2008 Bayer
D566,099 S 4/2008 Komiyama
D566,691 S 4/2008 Andre et al.
D568,302 S 5/2008 Oh
D569,841 S 5/2008 Chung et al.
7,394,910 B2 7/2008 Smith et al.
D575,277 S 8/2008 Gaarde et al.
D575,772 S 8/2008 Schultz et al.
7,412,068 B2 8/2008 Bayer
D578,507 S 10/2008 Ando
D578,508 S 10/2008 Wang
D579,006 S 10/2008 Kim et al.
D582,389 S 12/2008 Bose et al.
D582,397 S 12/2008 Christopher
D582,398 S 12/2008 Nam et al.
D582,889 S 12/2008 Bose et al.
D584,284 S 1/2009 Carr et al.
D584,294 S 1/2009 Nam et al.
D585,881 S 2/2009 Nam et al.
D588,099 S 3/2009 Yuyama
D589,945 S 4/2009 Esses
7,536,008 B2 5/2009 Howes et al.
7,539,533 B2 5/2009 Tran
D596,164 S 7/2009 Henning
D601,134 S 9/2009 Elabidi et al.
D602,476 S 10/2009 Lee et al.
D605,170 S 12/2009 Keinanen
D605,628 S 12/2009 Ando
7,627,131 B2 12/2009 Nielsen et al.
D607,875 S 1/2010 Pedersen, II
D618,219 S 6/2010 Burgett et al.
D618,221 S 6/2010 Fahrendorff et al.
D620,927 S 8/2010 Li
D621,817 S 8/2010 Brickstad
D622,265 S 8/2010 Rye
D622,704 S 8/2010 Fahrendorff et al.
7,778,410 B2 8/2010 Liu et al.
7,778,435 B2 8/2010 Smith et al.
D628,188 S 11/2010 Koch
D633,481 S 3/2011 Chen
D634,305 S 3/2011 Hoggarth
7,949,127 B2 5/2011 Pedersen et al.
D640,670 S 6/2011 Rye
7,965,855 B1 6/2011 Ham
D641,747 S 7/2011 Gisborne
8,009,853 B2 8/2011 Ito et al.
D645,458 S 9/2011 Silvestri et al.
D655,693 S 3/2012 Silvestri et al.
8,139,781 B2 3/2012 Cheng et al.
8,139,806 B2 3/2012 Hosaka et al.
8,184,841 B2 5/2012 Wurfel
8,249,287 B2 8/2012 Silvestri et al.
8,374,375 B2 2/2013 Hu
8,406,447 B2 3/2013 Kromann et al.
8,465,151 B2 6/2013 Howell et al.
8,532,324 B2 9/2013 Oosato
8,538,056 B2 9/2013 Ishibashi et al.

(56) References Cited

U.S. PATENT DOCUMENTS 8,540,363 B2 9/2013 Abreu
8,611,969 B2 12/2013 Smith et al.
8,630,436 B2 1/2014 Berg
8,638,970 B2 * 1/2014 Burton ..... H04R 1/1016 381/380
8,666,102 B2 3/2014 Bruckhoff et al.
8,696,113 B2 4/2014 Lewis
8,792,663 B2 7/2014 Cano et al.
8,873,786 B2 10/2014 Larsen et al.
8,891,800 B1 * 11/2014 Shaffer ..... H04R 1/1025 381/384
8,897,480 B2 11/2014 Tan et al.
8,976,994 B2 3/2015 Howes
8,976,995 B2 3/2015 Berg
9,002,023 B2 4/2015 Gauger, Jr.
9,118,990 B2 8/2015 Hankey et al.
9,146,397 B2 9/2015 Jacobs et al.
9,161,118 B2 10/2015 Howes
9,532,126 B1 12/2016 Kelly et al.
9,723,394 B2 8/2017 Anderson et al.
9,736,569 B2 8/2017 Kelly et al.
9,843,853 B2 * 12/2017 Hirsch ..... H02J 7/0044
9,967,649 B2 5/2018 Chandramohan et al.
10,003,878 B2 6/2018 Ushakov
10,003,880 B2 6/2018 Wagman et al.
10,025,103 B2 7/2018 Sugihara et al.
10,129,626 B1 11/2018 Jung et al.
10,212,506 B2 2/2019 Panecki et al.
10,251,789 B2 * 4/2019 Blumer ..... H04R 25/60
10,602,255 B2 * 3/2020 Sandanger ..... H04R 1/1016
10,659,862 B1 * 5/2020 Rugolo ..... H04R 1/105
10,659,864 B2 5/2020 Lo et al.
10,812,887 B2 10/2020 Berg
10,888,039 B2 1/2021 Milevski et al.
10,891,800 B1 1/2021 Stoyles et al.
2002/0096391 A1 7/2002 Smith et al.
2002/0131585 A1 9/2002 Jones et al.
2002/0172386 A1 11/2002 Bayer
2003/0059075 A1 3/2003 Niederdrank
2003/0091210 A1 5/2003 Baskerville
2003/0174853 A1 9/2003 Howes et al.
2003/0199850 A1 10/2003 Chavez et al.
2004/0045558 A1 3/2004 Taylor et al.
2004/0163653 A1 8/2004 Fleming
2004/0165743 A1 8/2004 Bayer
2005/0008180 A1 1/2005 Smith et al.
2006/0067556 A1 3/2006 Bailey et al.
2006/0093178 A1 5/2006 Chen
2006/0120546 A1 6/2006 Tanaka
2006/0177080 A1 8/2006 Smith
2006/0188122 A1 8/2006 Smith
2006/0215864 A1 9/2006 Espersen et al.
2007/0116309 A1 5/2007 Smith
2007/0183615 A1 8/2007 Wurfel
2007/0254725 A1 11/2007 Smith
2008/0075316 A1 * 3/2008 Chan ..... H04R 1/105 381/381
2008/0085030 A1 4/2008 Smith
2008/0159577 A1 7/2008 Smith
2008/0181441 A1 7/2008 Smith
2008/0247561 A1 10/2008 Smith
2008/0298626 A1 12/2008 Dean
2009/0092269 A1 4/2009 Nielsen et al.
2009/0141923 A1 6/2009 Smith
2009/0180654 A1 7/2009 Nielsen
2009/0202094 A1 8/2009 Ammitzboll et al.
2009/0202098 A1 8/2009 Chan et al.
2009/0226025 A1 9/2009 Howes et al.
2009/0285436 A1 11/2009 Lowry
2009/0296975 A1 12/2009 Uchida et al.
2009/0323993 A1 12/2009 Slemming et al.
2010/0217098 A1 8/2010 LeBoeuf et al.
2010/0278364 A1 11/2010 Berg
2011/0170731 A1 * 7/2011 Beckhart ..... H04R 5/0335 381/381
2011/0188690 A1 8/2011 Larsen et al.
2011/0280425 A1 11/2011 Gibbons
2012/0039500 A1 2/2012 Silvestri et al.
2012/0039501 A1 2/2012 Silvestri et al.
2012/0128192 A1 * 5/2012 Burgett ..... H04R 1/1083 381/380
2012/0128193 A1 5/2012 Stevinson
2012/0155689 A1 * 6/2012 Milodzikowski .... H04R 1/1016 381/379
2012/0321114 A1 12/2012 Ishibashi et al.
2013/0235328 A1 9/2013 Cauvet et al.
2013/0343595 A1 * 12/2013 Zorkendorfer ..... H04R 1/1016 381/380
2014/0140567 A1 5/2014 LeBoeuf et al.
2015/0036859 A1 2/2015 Tu et al.
2015/0071477 A1 3/2015 Mainini
2016/0261942 A1 9/2016 Hayden
2016/0317351 A1 11/2016 Ryan
2016/0317352 A1 11/2016 Blumer et al.
2017/0195807 A1 * 7/2017 Higgins ..... H04R 1/1058
2017/0195808 A1 7/2017 Higgins et al.
2018/0132026 A1 5/2018 Liang et al.
2018/0332379 A1 11/2018 McGarry et al.
2020/0084532 A1 3/2020 Lo et al.
2020/0204898 A1 6/2020 Schoeck et al.
2020/0266640 A1 8/2020 Valenzuela
2020/0404408 A1 12/2020 Silvestri et al.

* cited by examiner

EARPHONE DEVICE SUPPORT AND CASE

CROSS REFERENCE TO RELATED APPLICATIONS

This application claims priority to U.S. Provisional Patent Application No. 62/820,793, filed Mar. 19, 2019, which is herein incorporated by reference in its entirety.

BACKGROUND

Field

Embodiments described herein generally relate to earphone devices and, more particularly, to earphone device supports and earphone support cases.

Description of the Related Art

Audio devices allow users to receive audio content or audio information from various media sources, such as internet, video players, gaming devices, music playing platforms, or other types of audio generating devices. Typical portable in-ear audio devices may include various tethered and wireless headphones or other similar devices. Some common types of in-ear audio devices include earphones, in-ear monitors, and hearing aids. Listening devices, such as earphones and in-ear monitors can be hard-wired or wirelessly connected to an audio source to listen to audio provided to the device.

It is generally preferable to customize the shape of an in-ear audio device to a user's ear, so that the in-ear audio device is comfortable to wear, the in-ear audio device is easily retained in the user's ear, and any surrounding ambient noise can be eliminated or controlled when the in-ear audio device is inserted within the user's ear. Traditionally, custom-fit in-ear audio devices have used a wax-molding process to tailor the in-ear audio device to the unique shape of a user's ear. Although this wax-molding process can achieve a well-fitting custom in-ear audio device for a user, the process can be time-consuming and expensive. The process may require the user to travel to a location where a business can perform the wax molding of the user's ear. Then the user must wait multiple days until the custom in-ear audio device can be produced based on the wax molding and then sent to the user.

Furthermore, conventional earphones and similar devices generally lack any effective replaceable supporting elements that can fit onto the earphone device and can be custom-fit to a user's ear to maintain retention in the ear. The lack of retention is especially problematic when a user is participating in an intense physical activity, such as running. For example, conventional supporting elements may be difficult to insert or easily fall off the earphone device. Additionally, conventional supporting elements may be uncomfortable, which can cause pain in a user's ear and render the supporting element unusable. Furthermore, conventional supporting elements may block sound waves from entering the user's ear, making the audio difficult for a user to hear.

Accordingly, there is a need for effective ear supporting elements that are custom-fit to a user's ear and maintain retention in the ear.

SUMMARY

One or more embodiments described herein generally relate to earphone device supports and earphone support cases. Embodiments of the of disclosure may provide an earphone support includes a main body including an user interfacing surface; an outer surface; and a sound delivery tube extending through the main body between the user interfacing surface and the outer surface, wherein the user interfacing surface is configured to be positioned over a sound emitting end of an earphone device so that a port within the sound emitting end of the earphone device is in fluid communication with the sound delivery tube; and a supporting element extending from the main body, wherein the supporting element has a curvature that is shaped to follow a contour of the non-sound emitting end of the earphone device that is opposite to the sound emitting end of the earphone device.

Embodiments of the disclosure may further provide an earphone support, comprising a main body comprising an inner mounting surface, a user interface surface, and a sound delivery tube extending through the main body between the user interface surface and the inner mounting surface, and a supporting element extending from the main body. The inner mounting surface is configured to be positioned over a sound emitting region of an earphone device so that a port within the sound emitting region of the earphone device is in fluid communication with the sound delivery tube. The supporting element is shaped to follow a contour of the non-sound emitting region that is on a side of the earphone device that is opposite to the sound emitting region of the earphone device. The supporting element can also have a shape that is configured to generate a holding force that causes a portion of the inner mounting surface to be in intimate contact with portion of the sound emitting region of the earphone device.

Embodiments of the disclosure may further provide an earphone support includes a main body including an user interfacing surface; an outer surface; and a sound delivery tube extending through the main body between the user interfacing surface and the outer surface, wherein the user interfacing surface is configured to be positioned over a sound emitting end of an earphone device so that a port within the sound emitting end of the earphone device is aligned with the sound delivery tube; and a supporting element extending from the main body, wherein the supporting element has a curvature that is shaped to follow a contour of the non-sound emitting end of the earphone device that is opposite to the sound emitting end of the earphone device, and the curvature of the supporting element has a shape that is configured to generate a holding force that causes a portion of the user interfacing surface to be in intimate contact with portion of the sound emitting end of the earphone device.

Embodiments of the disclosure may further provide an earphone support case includes a main body including a receiving area proximate a first end of the main body, the receiving area comprising a plurality of earphone support mounts, each of the plurality of earphone support mounts configured to support one of a plurality of earphone supports; and an open end opposite the first end of the main body, wherein the open end is configured to mate with an earphone device case; and a lid coupled to the main body by a hinge, wherein the hinge is configured to move the lid between an open state and a closed state.

Embodiments of the disclosure may further provide an earphone case, comprising a case body and a lid coupled to the case body by a hinge, wherein the hinge is configured to allow the lid to pivot between an open state and a closed state. The case body may comprise a receiving area proximate a first end of the case body, the receiving area comprising a plurality of earphone support mounts, each of the plurality of earphone support mounts configured to support one of a plurality of earphone supports; and an open end opposite the first end of the case body, wherein the open end is configured to receive at least a portion of an earphone device case that is configured to at least partially enclose a plurality of earphones.

Embodiments of the disclosure may further provide an earphone case, comprising a case body, a lid coupled to the case body by a hinge, wherein the hinge is configured to allow the lid to pivot between an open state and a closed state, and a sensor positioned to detect a change in a generated magnetic field. The case body may comprise a receiving area proximate a first end of the case body, the receiving area comprising a plurality of earphone support mounts, each of the plurality of earphone support mounts configured to support one of a plurality of earphone supports, wherein the earphone support mounts comprise a magnetic field generating device that is configured to generate the generated magnetic field, and an open end opposite the first end of the case body, wherein the open end is configured to receive at least a portion of an earphone device case that is configured to at least partially enclose a plurality of earphones.

Embodiments of the disclosure may further provide an earphone case, comprising a case body, a lid coupled to the case body by a hinge, wherein the hinge is configured to allow the lid to pivot between an open state and a closed state, and a magnetic field controlling device. The case body having a receiving area proximate a first end of the case body, the receiving area comprising a plurality of earphone support mounts, each of the plurality of earphone support mounts include a mounting surface configured to support one of a plurality of earphone supports, wherein the earphone support mounts comprise a magnetic field generating device that is configured to generate a magnetic field that passes through the mounting surface, and an open end opposite the first end of the case body, wherein the open end is configured to receive at least a portion of an earphone device case that is configured to at least partially enclose a plurality of earphones. The magnetic field controlling device being configured to generate a magnetic field that has a first magnetic field strength when one of the earphone supports is positioned on the mounting surface, and generate a magnetic field that has a second magnetic field strength when the one of the earphone supports is separated from the mounting surface.

Embodiments of the disclosure may further provide a method of positioning an earphone support on an earphone device, comprising positioning a sound emitting region of the earphone device against an inner mounting surface of the earphone support while a surface of a main body of the earphone support is positioned on a surface of a support mount, and separating the surface of the main body of the earphone support from the surface of the support mount by performing a separating motion, wherein the separating motion comprises moving the earphone device and earphone support in a first direction and tilting the earphone device.

Embodiments of the disclosure may further provide a method of positioning an earphone support on an earphone device, comprising positioning a sound emitting region of the earphone device against an inner mounting surface of the earphone support, and separating the surface of the main body of the earphone support from the surface of the support mount by performing a separating motion, wherein the separating motion comprises moving the earphone device and earphone support in a first direction and tilting the earphone device. Also, while positioning the earphone device against the inner mounting surface of the earphone support, a surface of a main body of the earphone support is positioned on a surface of a support mount, and an external region of the earphone device is positioned against a surface of a supporting element of the earphone support, such that, when the supporting element is positioned against the external region of the earphone device, the sound emitting region is caused to be positioned against the surface of a main body of the earphone support.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Figure 1:
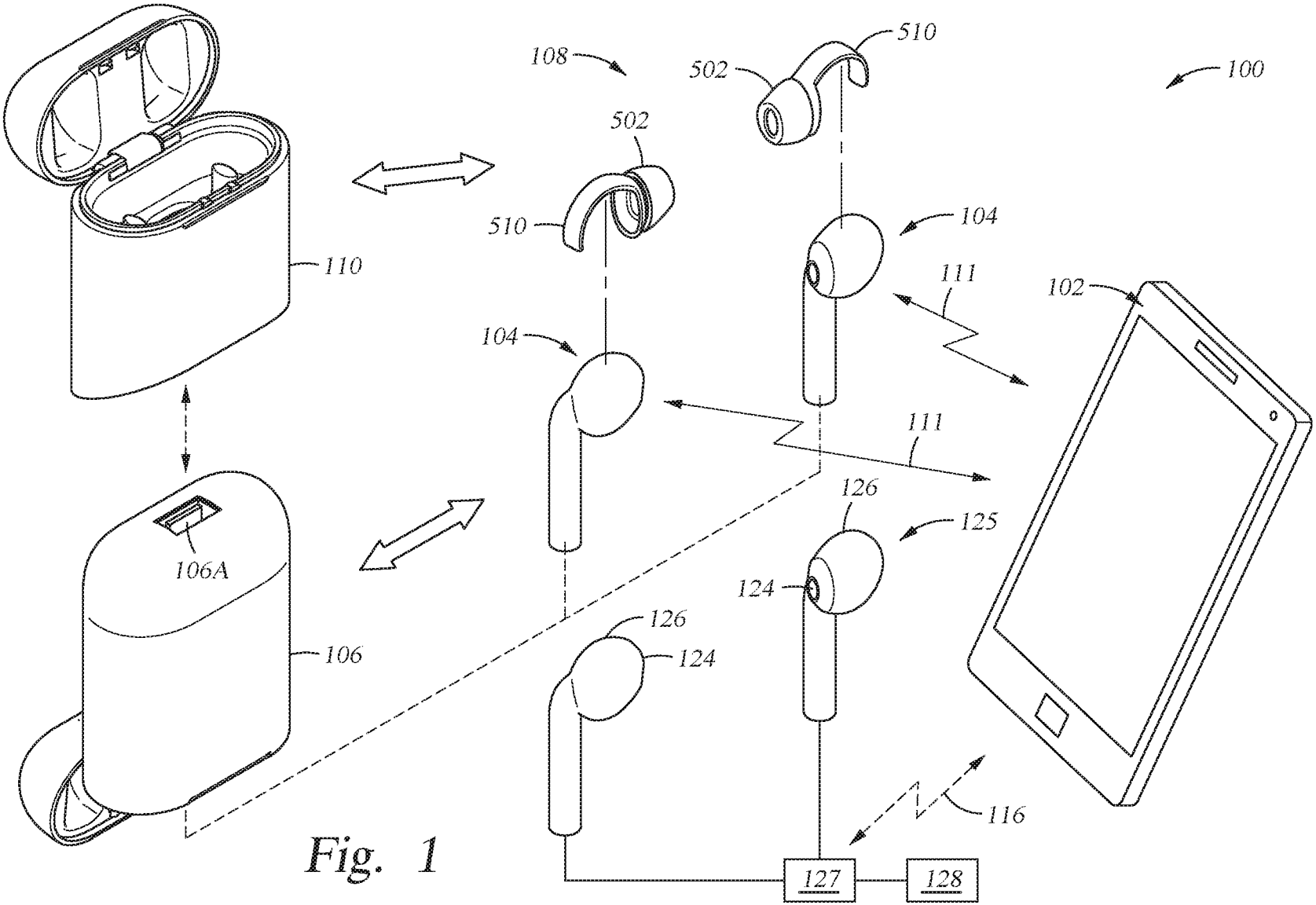
FIG. 1 is a perspective view of an audio device customization system according to at least one embodiment described herein.

In the following description, numerous specific details are set forth to provide a more thorough understanding of the embodiments of the present disclosure. However, it will be apparent to one of skill in the art that one or more of the embodiments of the present disclosure may be practiced without one or more of these specific details. In other instances, well-known features have not been described in order to avoid obscuring one or more of the embodiments of the present disclosure.

Embodiments described herein generally relate to an earphone support that is configured to be positioned on and coupled to an in-ear audio device to improve retention of the in-ear audio device in a user's ear and improve the user's listening experience and overall comfort. In some embodiments described herein, the earphone supports are each configured to be positioned over a sound emitting end of an in-ear audio device, or hereafter earphone device. In general, earphone devices can include earbuds, or other similar devices that rest in the outer portion of a user's ear and generally outside of the user's ear canal. An earphone support typically includes a main body and a supporting element that extends therefrom. In some embodiments, the supporting element has an arcuate or curved shape that allows the supporting element to follow and rest against a contour of the earphone device. The shape of the supporting element is configured to cause a portion of the main body to be positioned against a surface of a sound emitting end of the earphone device. The interaction of the supporting element with the earphone device, when an earphone support is positioned on an earphone device, allows the earphone support to be secured to the earphone device to form a secured separable earphone assembly. Therefore, due to the external shape and properties of the earphone support within the secured separable earphone assembly, the earphone device will have an improved retention within a user's ear. Therefore, users of secured separable earphone assembly can participate in intense physical activities, such as running, without having the earphone device falling out of their ears.

As is discussed further below, in some embodiments, the earphone support 108 (FIGS. 1 and 5-6) includes a sound delivery tube 508 extending through the main body 502 between a user interfacing surface 504 and an inner mounting surface 515. The main body 502 includes an inner mounting surface 515 that is configured to be positioned over a sound emitting end 402 of the earphone device 104 such that a port 403 within the sound emitting end 402 of the earphone device 104 is in fluid communication with the sound delivery tube 508 of the main body 502. Positioning the earphone support 108 on the earphone device 104 also provides an advantage of directing the sound waves generated in the earphone device 104 through the sound delivery tube 508 of the earphone support 108 and into a user's ear (e.g., item 200 in FIG. 2A) so that a user can clearly hear the generated audio content provided from the earphone device 104.

Embodiments described herein also generally relate to a removable earphone support case 110 that is adapted to be positioned over an earphone device case 106 (FIGS. 8-14). The earphone device case 106 is configured to support and house the earphone devices 104 during times of non-use, and the earphone support case 110 is configured to support, house and/or securely store the earphone supports 108. The earphone support case 110 includes a lid 910 (FIG. 9) that is coupled to a case body 902 by a hinge 914 that is positioned at a first end 951 of the case body 902. The hinge 914 allows the movement of the lid 910 between an open state (FIG. 9) and a closed state, in which the lower surface of the lid 910 rests against a surface of the case body 902 to enclose the earphone supports 108. The case body 902 of the earphone support case 110 includes an earphone support receiving area 904 proximate to a first end 951 of the case body 902. The receiving area 904 includes a plurality of earphone support mounts 906. Each of the earphone support mounts 906 are configured to support an earphone support 108 so that each earphone support 108 can be securely positioned within the receiving area 904, separate from an earphone device 104, during times of non-use. The earphone support mounts 906 provide the advantage of allowing the earphone supports 108 to be securely stored within the earphone support case 110 during times of non-use. As will be discussed further below, the earphone support mounts 906 also allow the easy mounting, detaching and/or remounting an earphone support 108 on an earphone device 104 by performing a separating motion and a reverse-separating motion that includes processes for inserting and removing the earphone device 104 from a device retaining region 513, defined by the inner mounting surface 515 of the main body 502 and an inner surface 514 of the supporting element 510 (FIG. 5) of an earphone support 108 that is positioned on an earphone support mount 906. Therefore, users can easily carry around, store and locate the earphone supports, easily remove the earphone supports 108 from the earphone support mounts 906, easily mount, detach and remount the earphone support 108 on an earphone device 104, and easily position the earphone supports 108 onto the earphone support mounts 906.

The case body 902 of the earphone support case 110 also has an open end (i.e., second end 952) opposite the first end 951. The open end includes an internal region that has a case body inner surface 903 (FIGS. 10A-10B) that is configured to conform to a portion of a case outer surface 106B (FIG. 8) of an earphone device case 106. By positioning the portion of the earphone device case 106 within the internal region of the earphone support case 110 provides the advantage of allowing the earphone support case 110 and earphone device case 106 to be positioned together to form a single assembly that is separably attached to each other. As such, by having the two cases together, the earphone devices 104 and earphone supports 108 can easily be located and used with one another by a user.

FIG. 1 is a perspective view of an audio device customization system 100 according to at least one embodiment described herein. The audio device customization system 100 includes earphone supports 108 and an earphone support case 110. Each of the earphone supports 108 are configured to be positioned on an earphone device 104, which is configured to be housed with an earphone device case 106. For example, the earphone device case 106 can have one or more cavities that are each configured to receive one of the earphone devices 104. Typically, the cavities can be sized and shaped to match each respective earphone device 104. The earphone device case 106 can have a lid which can be aligned over the one or more cavities such that the earphone device case 106 houses the earphone devices 104.

Each of the earphone supports 108 is configured to be positioned over at least a portion of one of the earphone devices 104 to form a secured separable earphone assembly 101, which is shown in FIGS. 2B and 7A-7D and discussed further below. Each of the earphone supports 108 is designed to be inserted and stored in the earphone support case 110, which will be described in more detail in more below. The earphone support case 110 provides the advantage of securely storing the earphone supports 108 within the earphone support case 110 when they are not being used to form the secured separable earphone assembly 101. Moreover, the earphone support case 110 is also configured to mate with the earphone device case 106, such that the earphone support case 110 and earphone device case 106 can be carried together by a user, the earphone support case 110 carrying the earphone supports 108 and the earphone device case 106 carrying the earphone devices 104. Additionally, the earphone device case 106 includes a power delivery port 106A, which is located on one end of the case outer surface 1066. In some embodiments, the earphone device case 106 is inserted within the earphone support case 110 such that power delivery port 106A is proximate an aperture 919 (FIG. 9) within the earphone support case 110. Therefore, a user can charge the earphone device case 106 by placing a power cord through the aperture 919 and into the power delivery port 106A, advantageously allowing a user to easily charge the earphone device case 106 along with the earphone support case 110.

As will be discussed further below, in some embodiments, the audio device customization system 100 may further optionally include an earphone support curing assembly 125 that is configured to cure a curable filler material 509 (FIG. 5) that is disposed within a sleeve 507 (FIG. 5) of an earphone support 108. Therefore, by performing a curing process, in which the earphone support 108 is first positioned against a portion of a user's ear so that the uncured curable filler material 509 and sleeve 507 conform to the shape of a user's ear, and then curing the deformed curable filler material 509 to form a fixed shape, the secured separable earphone assembly 101 forms a fixed custom external shape that is configured to match the shape of a user's ear. The curing step can be performed by exposing the curable filler material 509 and sleeve 507 to electromagnetic radiation generated by an electromagnetic radiation source 124 that is positioned within the earphone curing device 126 of the earphone support curing assembly 125 when the earphone support 108 is positioned on an earphone curing device 126 that is positioned within a user's ear during the curing process. Portions of the exterior surfaces of the earphone curing device 126 are similarly shaped like an earphone device 104 to allow the cured earphone support 108 to then be similarly positioned on an earphone device 104 so that the cured earphone support 108 will form part of the secured separable earphone assembly 101 after the curing process has been performed and the cured earphone support 108 has been removed from the earphone curing device 126 and similarly positioned on an earphone device 104. In one example, the curing device 126 includes at least a surface that is shaped like surface 402A of the sound emitting end 402 of an earphone device 104 and a surface that is shaped like surface 404A of the non-sound emitting end 404 of the earphone device 104 to allow the cured earphone support 108 to be similarly coupled to a similarly configured earphone device 104. Thus, the comfort level of the earphone support 108 and the retention of the earphone device 104 within a user's ear are enhanced. In some embodiments, the curing process that is performed by the earphone support curing assembly 125 is activated by the use of an electronic device 102. The electronic device 102 can be a smartphone (shown in FIG. 1), a computer, a tablet, or other similar devices that is configured to communicate with the earphone support curing assembly 125 via a wired or wireless communication link 116.

Together, the audio device customization system 100 provides for a convenient, efficient, and comfortable way for a user to listen to audio signals generated by the earphone devices 104. The electronic device 102 may also be directly connected to or wirelessly paired with earphone devices 104 via a communication link 111. Typically, wireless communication between the earphone device(s) 104 with the electronic device 102 is desired by users, since it provides a convenient way for a user to listen to music without the constraints of wiring.

Figure 2A:
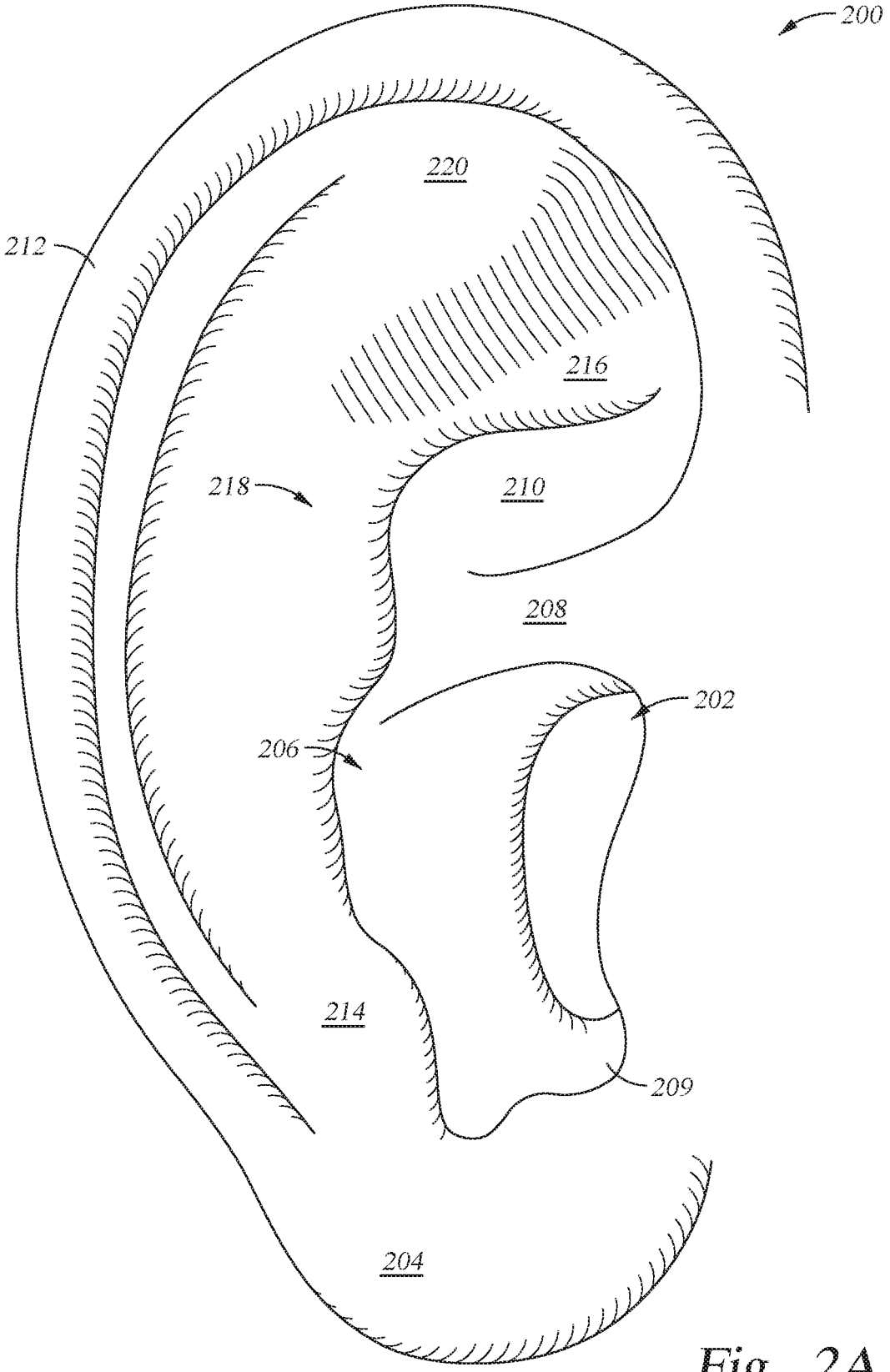
FIG. 2A is an exemplary illustration of a human ear.

FIG. 2A is an exemplary illustration of a human ear 200. The earphone supports 108 are configured to conform to portions of the user's ear 200 for a snug and comfortable fit. A description of these portions of the ear 200 follows and is useful for understanding how the earphone supports 108 are configured to conform to a user's ear 200 in subsequent portions of this description.

The ear 200 includes an ear canal 202 leading to an ear drum (not shown). Ear lobe 204 forms a lower portion of the ear 200 and a helix 212 extends from the ear lobe 204 to a top portion of the ear 200. The ear canal 202 is surrounded by the cavum conchae 206, the crus helix 208, the tragus 209, and the antitragus 214. The cavum conchae 206 has a recessed shape (e.g., bowl shape) relative to the surrounding portions of the ear 200 other than the ear canal 202. The earphone support 108 can be placed in this recessed shape of the cavum conchae 206 as more fully described below. The antitragus 214 is a projection extending from the ear lobe 204 towards the ear canal 202. The tragus 209 is a projection extending from the face (not shown) towards and/or over the ear canal 202. The crus helix 208 is a spiny portion extending from above the tragus 209 to the cavum conchae 206. The antihelix 218 is disposed between the helix 212 and the crus helix 208. The antihelix 218 is separated from the crus helix 208 by the cymba conchae 210, which is recessed relative to the crus helix 208 and the antihelix 218. The portion of the antihelix 218 that is connected to the cymba conchae 210 is the crus antihelicis inferioris 216. The portion of the antihelix 218 that extends to the helix 212 is the crus antihelicis superioris 220.

Figure 2B:
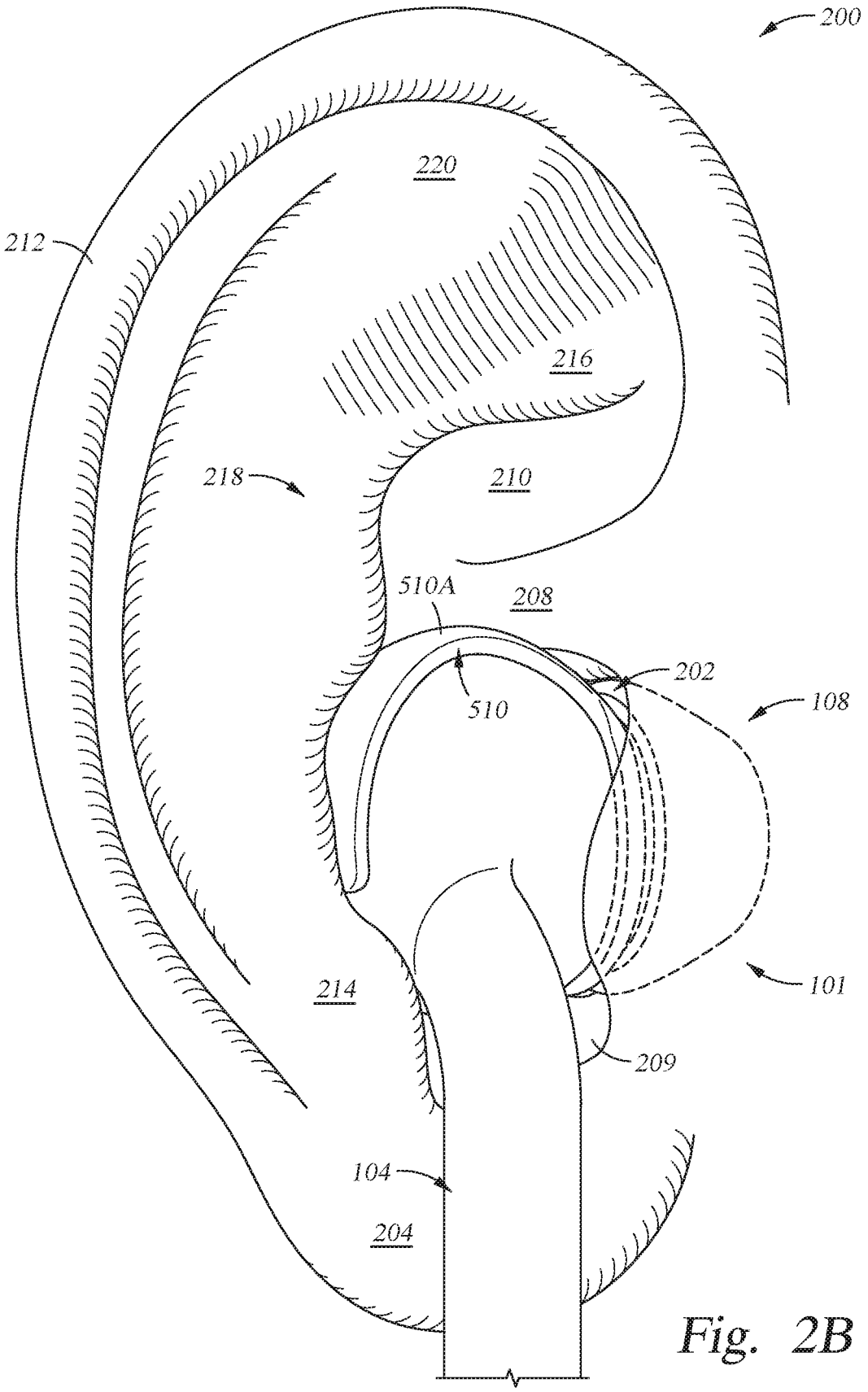
FIG. 2B is a perspective view of the earphone support disposed within a portion of the ear, according to at least one embodiment described herein.

FIG. 2B is a perspective view of the earphone support 108 disposed within a portion of the ear 200 after a user has inserted, and optionally in some cases customized the shape of the earphone support 108 to conform to the shape of the user's ear 200, according to at least one embodiment described herein. In some embodiments, the earphone support 108 is positioned within and is configured to deform so that it conforms to the shape of the user's ear canal 202 and cavum conchae 206. In this case, the earphone support 108 is configured to conform to the shape of the user's ear canal 202 and cavum conchae 206 by forming the main body 502 of the earphone support 108 from a compliant material (e.g., foam material, polymeric material (e.g., silicone), etc.) or by use the compliant sleeve 507 and curable filler material 509 that is discussed above and in more detail below. As shown in FIG. 2B, the earphone device 104 is opposite to the earphone support 108, and is adapted to rest against the cymba conchae 210 (FIG. 2A) and under the antihelix 218 and/or the crus antihelicis inferioris 216 when the earphone support 108 is disposed within a portion of the ear 200. The earphone support 108 and the earphone device 104 can conform to the shape of the different portions of the user's ear 200 described above when the user presses the earphone device 104 toward the user's ear 200.

Figure 3:
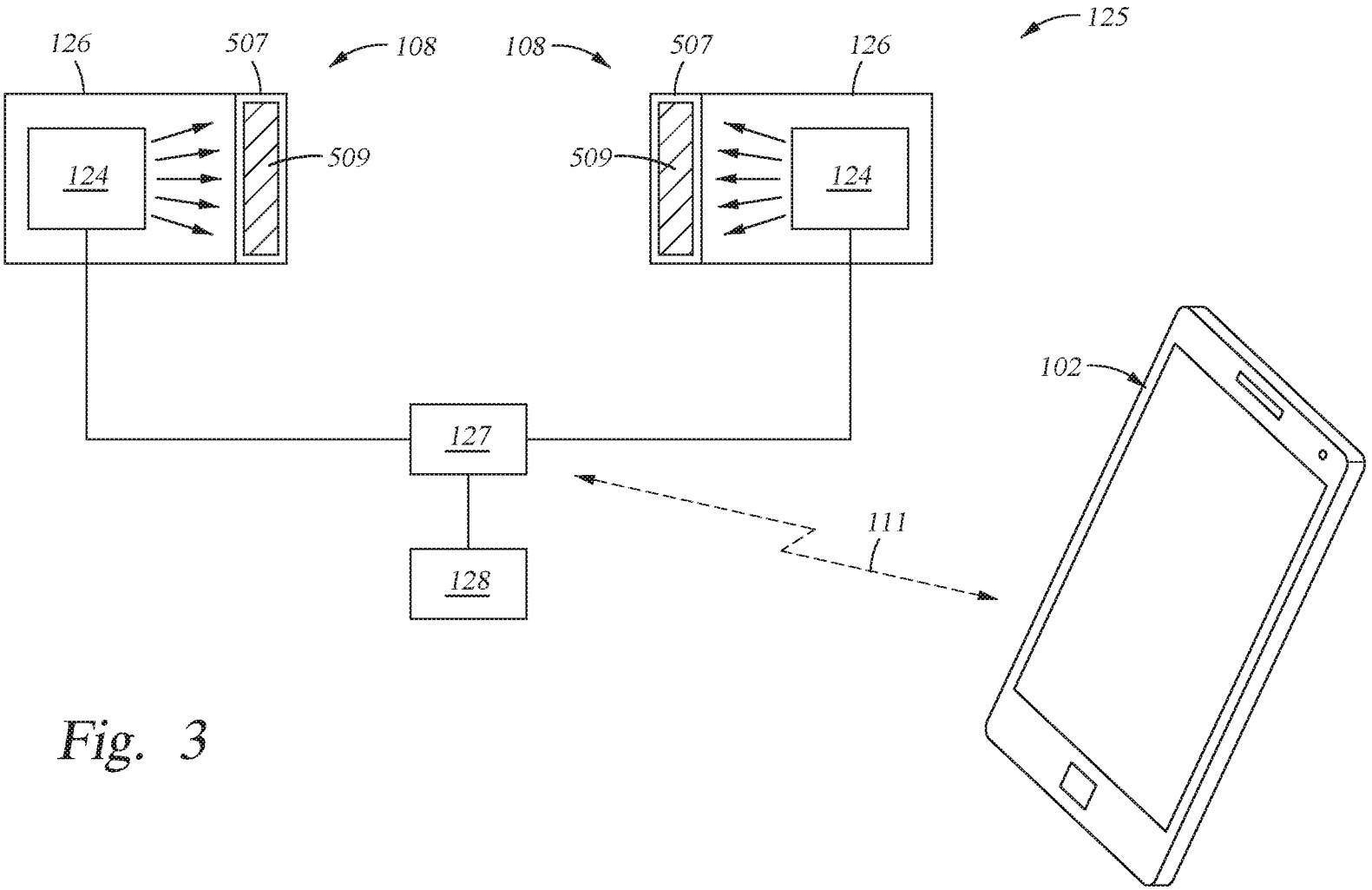
FIG. 3 is a schematic diagram of an audio device customization system, according to at least one embodiment described herein.

FIG. 3 is a schematic diagram of the earphone support curing assembly 125, according to at least one embodiment described herein. The earphone support curing assembly 125 includes one or more earphone curing devices 126. Typically, the earphone support curing assembly 125 includes two earphone curing devices 126 that are each shaped to match one of the earphone devices 104 in a pair of earphone devices 104, which are commonly differently configured to separately fit within a user's right and left ear. Each of the earphone curing devices 126 includes an electromagnetic radiation source 124, which can include a light emitting diode (LED). The electromagnetic radiation source 124 can be configured to emit radiation at a wavelength between about 345 nm and about 490 nm, such as at a wavelength between about 345 nm and about 420 nm, or a wavelength of about 405 nm to cure the curable filler material 509 disposed within the sleeve 507 of the earphone support 108. However, the electromagnetic radiation source 124 can also be configured to emit other desirable wavelengths that are used to cure a curable filler material 509.

The earphone support curing assembly 125 further includes a controller 127 and a power source 128. In some embodiments, the controller 127 can be used to initiate the curing process that is used to cause the earphone supports 108 to be fixed in a custom external shape that is configured to match the shape of a user's ear, as discussed above. The controller 127 can communicate with an electronic device 102 via the communication link 116. As such, a user can initiate the curing process from the electronic device 102 using a touchscreen feature, for example. In these embodiments, the power source 128 is used to provide power to the electromagnetic radiation source 124. The power source 128 can be one or more on-board batteries located within the earphone supports 108. However, the power source 128 can also be an external power source, such a larger external battery or an AC wall power outlet.

Figure 4:
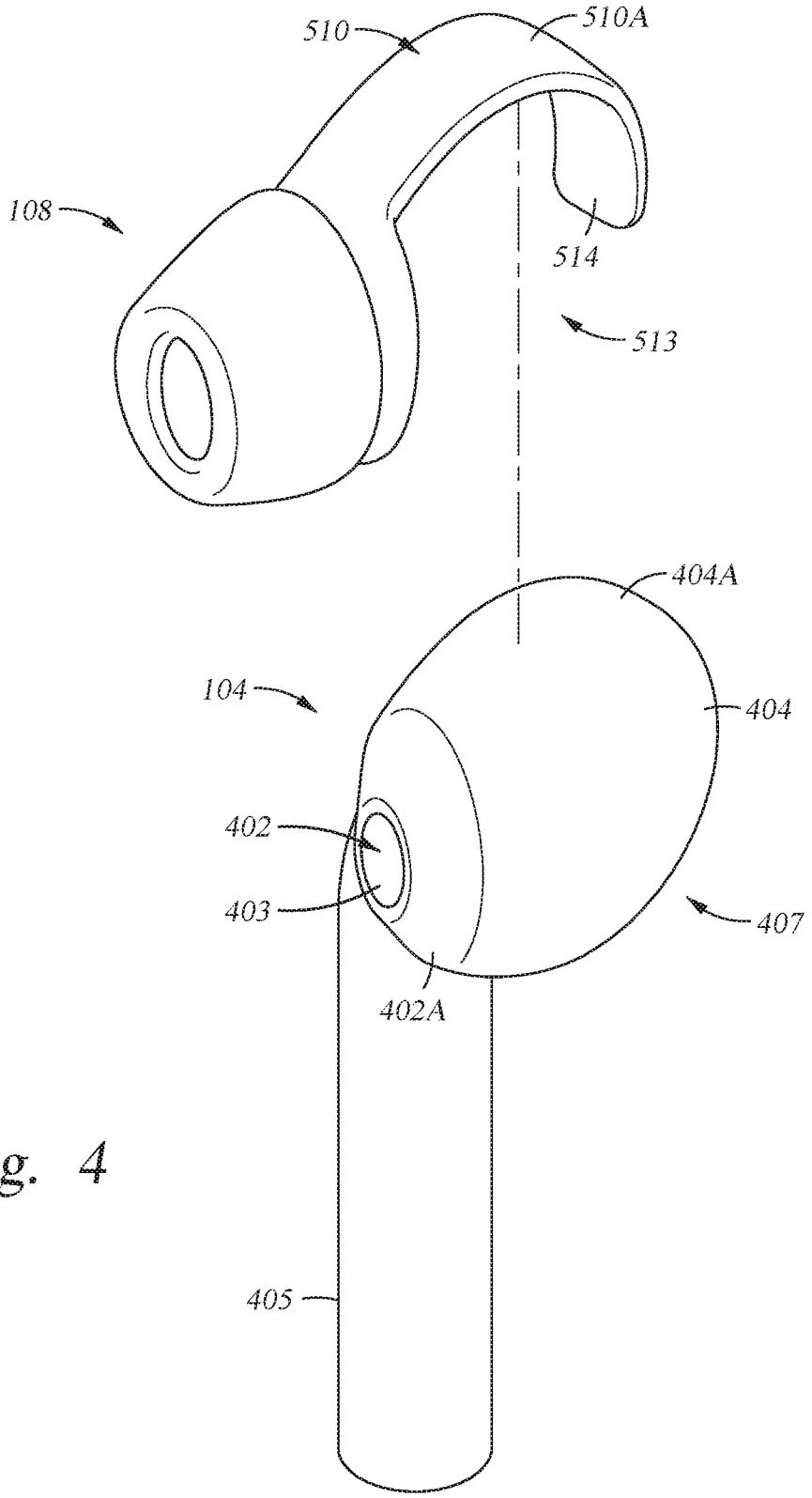
FIG. 4 is an exploded view of an earphone support and an earphone device, according to at least one embodiment described herein.

FIG. 4 is an exploded view of the earphone support 108 and the earphone device 104 of the secured separable earphone assembly 101, according to at least one embodiment described herein. In these embodiments, the earphone device 104 includes a sound generating portion 407 that includes a sound emitting end 402 and a non-sound emitting end 404 opposite the sound emitting end 402. The earphone device 104 will also include grip portion 405 that is coupled to sound generating portion 407. The earphone support 108 is configured to be positioned on a portion of the earphone device 104, such that the earphone support 108 can be easily inserted within a user's ear and audio can be heard by the user, which will be described in further detail below.

Figure 5:
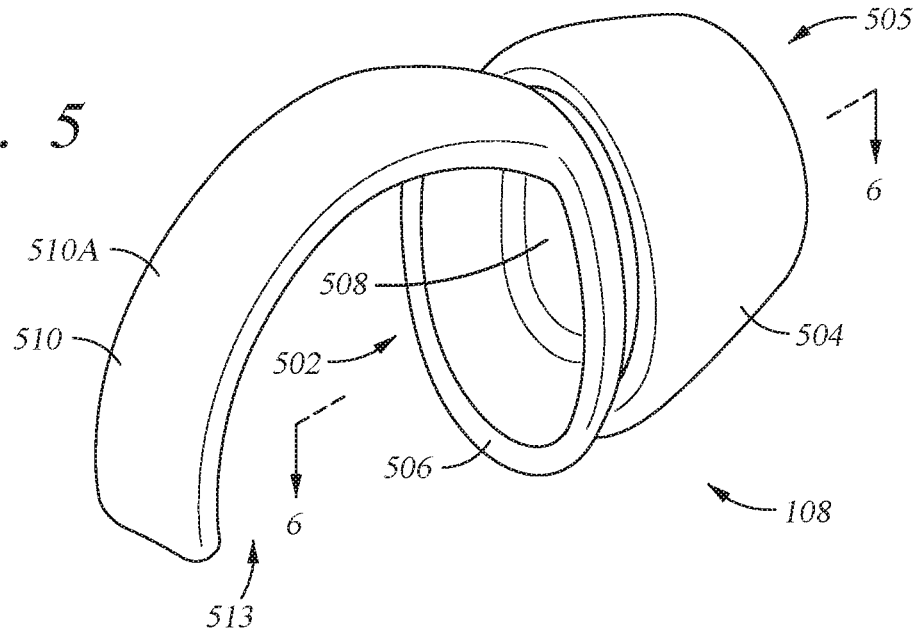
FIG. 5 is a perspective view of the earphone support, according to at least one embodiment described herein.
Figure 6:
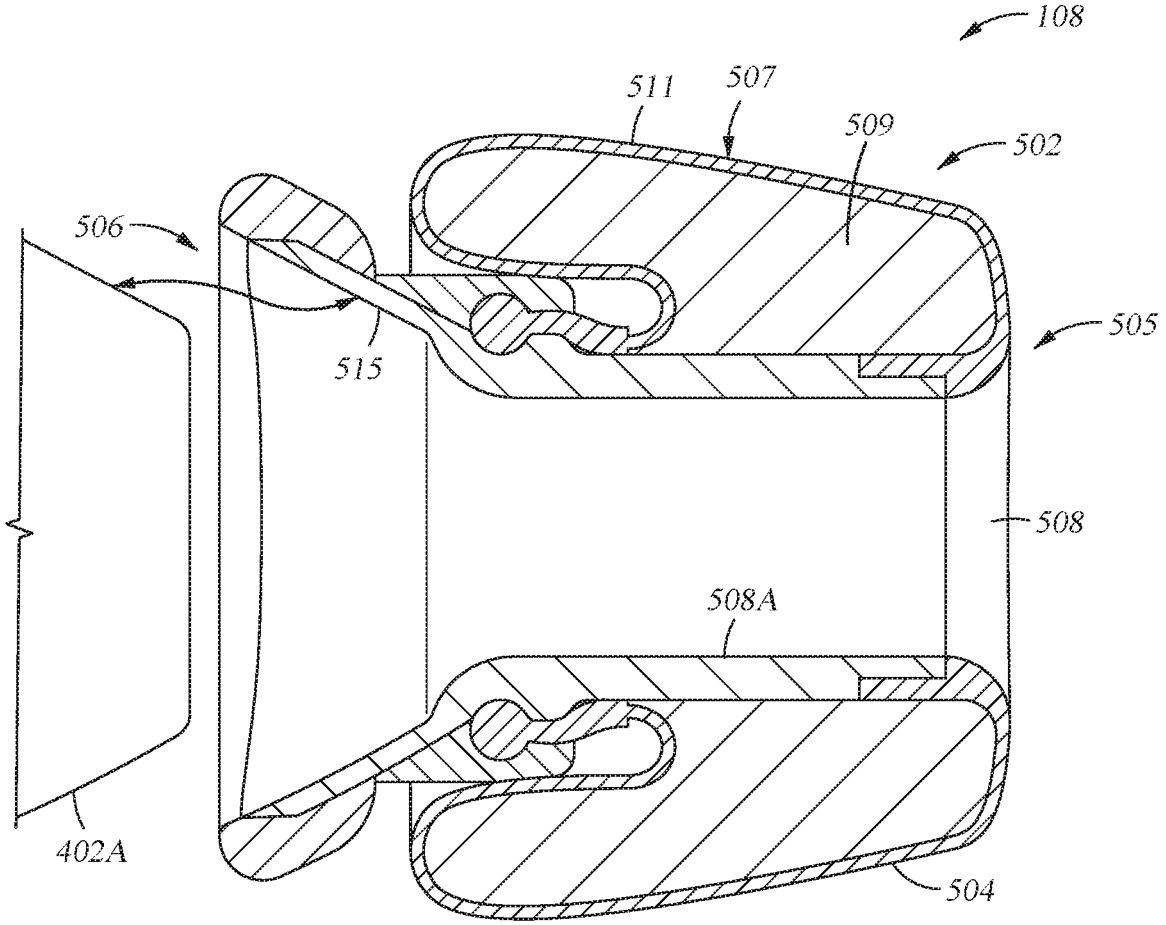
FIG. 6 a sectional view of the earphone support, according to at least one embodiment described herein.

FIG. 5 is a perspective view and FIG. 6 is a sectional view of the earphone support 108 according to at least one embodiment described herein. The earphone support 108 includes a main body 502. The main body 502 includes a first end 505 and a second end 506. In these embodiments, the main body 502 also includes a user interfacing surface 504 and an inner mounting surface 515. A sound delivery tube 508 extends through the main body 502 between the user interfacing surface 504 and the inner mounting surface 515. An ear interface component 511 includes a sleeve 507 and a curable filler material 509. The thickness on the sleeve 507 at the inner mounting surface 515 can have a thickness that is different from the thickness of the sleeve 507 at the sound delivery tube 508. The differing thicknesses can be used to help prevent or eliminate the collapse and wrinkling of the main body 502 when the earphone support 108 is inserted into the user's ear. The sound delivery tube 508 includes a sound tube inner surface 508A. The sound tube inner surface 508A is configured to fit over a support mount surface 907 (FIGS. 10A and 12) of the earphone support mounts 906, which is described in further detail below. As discussed above, the earphone support 108 also includes a supporting element 510 that extends from the main body 502. The supporting element 510 can be a curved or arcuate shape.

As briefly discussed above, the user interfacing surface 504 includes an inner mounting surface 515 that is configured to be positioned over a surface 402A of the sound emitting end 402 of the earphone device 104 such that a port 403 (FIG. 4) within the sound emitting end 402 of the earphone device 104 is in fluid communication with the sound delivery tube 508 of the main body 502. In one embodiment, the inner mounting surface 515 of the main body 502 is shaped to substantially match the surface profile of the surface 402A of the sound emitting end 402 of the earphone device 104. The matching shape of the inner mounting surface 515 allows for the easy alignment of the sound delivery tube 508 to the sound emitting end 402 of the earphone device 104 and improved coupling of the earphone support 108 to the earphone device 104.

The curable filler material 509 can be formed of a material that is biocompatible in both the uncured and cured state, so that potential contact with a user's skin does not irritate or harm the user. In some embodiments, in which the curable filler material is a photopolymer, the curable filler material 509 can include a concentration of photoinitiator to allow the curable filler material 509 to cure in about 30 seconds to about 120 seconds, such as curing in about 60 seconds. In some embodiments, the curable filler material 509 includes a polymer material, such as a silicone material. In some embodiments, the curable filler material 509 includes a fluoropolymer material, such as a fluorinated silicone material. In one embodiment, the curable filler material 509 includes fumed silica to enhance the mechanical properties of the curable filler material 509. The curable filler material 509 can have a viscosity before curing from about 15,000 cP to about 1,000,000 cP, such as from about 50,000 cP to about 120,000 cP, such as about 80,000 cP. In some embodiments, the curable filler material 509 can have a hardness after curing that is from about 20 Shore A scale to about 50 Shore A scale, such as about 30 Shore A after a curing process has been performed. In some embodiments, the curable filler material 509 can cure in about 30 seconds to about 120 seconds, such as in about 60 seconds.

The sleeve 507 can be formed from a flexible material, such as an elastic material that has a tendency to return to its original shape after a force had been applied to and removed from the elastic material. The sleeve 507 may be formed from a silicone, fluorosilicone, nitrile, acrylate, high consistency rubber (HCR), and thermoplastic elastomers (e.g., thermoplastic polyurethane (TPU), such as aliphatic TPU) material. The supporting element 510 portion of the earphone support 108 can also be formed from a flexible material, such as an elastic material. However, in some embodiments, the supporting element 510 is formed from a material that has a higher stiffness and/or durometer than the material used to form the sleeve 507. In some embodiments, the earphone support 108 is formed using a multistep injection molding process in which the supporting element 510 is formed from a first polymeric material that is injected into a mold during one step and the sleeve 507 is formed from a second polymeric material that is injected into a mold during another step, wherein the second polymeric material has different physical properties than the first polymeric material (e.g., higher durometer, Young's modulus, storage modulus, percent elongation). In one example, the first polymeric material comprises natural rubber, polypropylene, polyethylene, or polyester material, and the second polymeric material comprises silicone, fluorosilicone, nitrile, acrylate, high consistency rubber (HCR), and thermoplastic elastomers (e.g., thermoplastic polyurethane (TPU), such as aliphatic TPU) material.

Figure 7C:
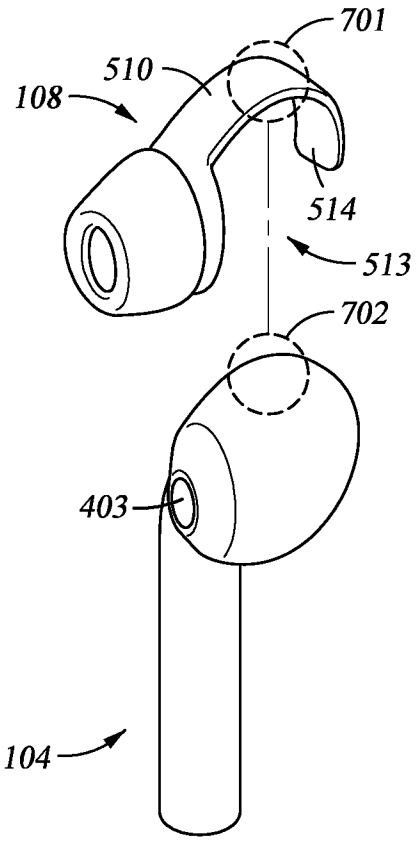
FIG. 7C is a perspective view of the earphone support and the earphone device with magnetic regions, according to at least one embodiment described herein.
Figure 7B:
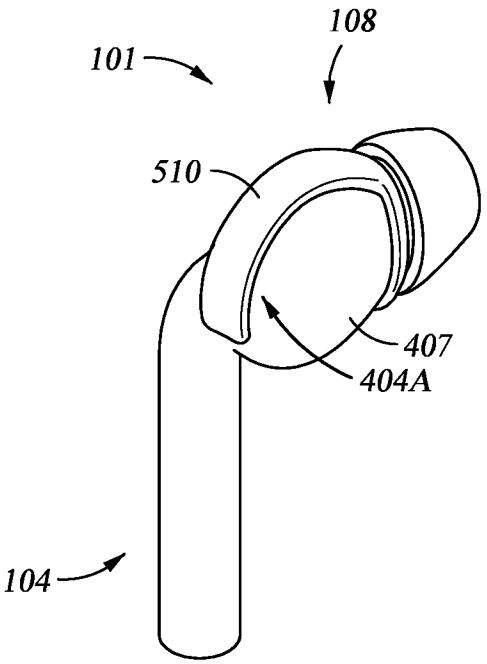
FIG. 7B is a rear perspective view of the earphone support positioned on an earphone device, according to at least one embodiment described herein.
Figure 7A:
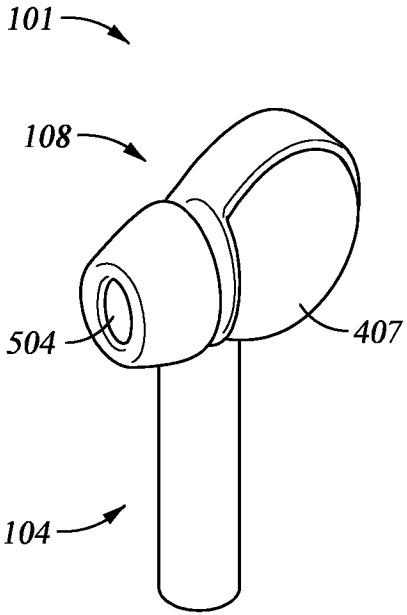
FIG. 7A is a front perspective view of the earphone support positioned on an earphone device, according to at least one embodiment described herein.

FIG. 7A is a front perspective view and FIG. 7B is a rear perspective view of the earphone support 108 that is positioned on the earphone device 104 to form a secured separable earphone assembly 101. As best shown in FIG. 7A, the inner mounting surface 515 of the earphone support 108 is configured to be positioned over the sound emitting end 402 of the earphone device 104. Therefore, a port 403 within the sound emitting end 402 is in fluid communication with the sound delivery tube 508 of the earphone support 108. As such, the sound waves of the audio signal emitted from the sound emitting end 402 can freely travel through the sound delivery tube 508 and then into a user's ear. Accordingly, when the earphone support 108 is placed within a user's ear, the user can clearly hear the audio coming from the sound emitting end 402 of the earphone device 104. As best shown in FIG. 7B, the supporting element 510 of the earphone support 108 is positioned on the non-sound emitting end 404 of the earphone device 104.

The supporting element 510 of the earphone support 108 has a curvature that is shaped to follow the contour of a surface 404A of the non-sound emitting end 404 of the earphone device 104. The shape is configured to generate a holding force that causes at least a portion of the inner mounting surface 515 to be in intimate contact with a portion of the sound emitting end 402 of the earphone device 104 (FIG. 7A). Therefore, the earphone support 108 is strongly and reliably secured to the earphone device 104, providing desired retention into a user's ear. Better retention allows for a user to participate in physical activities without the earphone device 104 falling out of the user's ear, as commonly found with most conventional earphone device 104 designs. The cured earphone support 108 also provides additional comfort and support to the earphone device 104 for the user.

In some embodiments, the exterior surface of the supporting element 510 is configured to extend a distance from the surface 404A of the earphone device 104 and fit against the human ear 200. For example, the exterior surface 510A of the supporting element 510 can include a feature that is configured to extend from the main body 502 of the earphone device 104 to an outer portion of the inner ear, such as against outer portions of the antihelix 218 and/or the crus antihelicis inferioris 216 (FIG. 2B), which are opposite to the main body 502 that is positioned in the ear canal 202. The feature of the supporting element 510 is used to provide additional retention and support of the secured separable earphone assembly 101 inside the human ear 200 (FIG. 2B). Together, these embodiments act to provide a desired amount of retention and support for a user using the secured separable earphone assembly 101. Therefore, the user can perform activities without the secured separable earphone assembly 101 falling out of the human ear 200.

FIG. 7C is a perspective view of the earphone support 108 and the earphone device 104 that include magnetic regions 701 and 702, respectively, according to at least one embodiment described herein. In these embodiments, the earphone support 108 includes a magnetic region 701 that is configured to mate with a magnetic region 702 found within the earphone device 104. The magnetic region 701 will include a ferromagnetic, ferrimagnetic or paramagnetic material that is positioned on or within the material used to form the supporting element 510 or main body 502. The material used to form the magnetic region 701 is configured to be attracted to the magnetic region 702 of the earphone device 104. In some embodiments, the magnetic region 701 is located on portion of the supporting element 510 of the earphone support 108. The magnetic region(s) 702 formed within portions of the earphone device 104 can include magnets positioned within the sound generating components found within earphone device 104 or non-audio generating auxiliary magnets positioned within the earphone device 104. Therefore, the magnetic region 701 of the earphone support 108 and the magnetic region 702 of the earphone device 104 are attracted to each other via a magnetic field generated by either or both of the magnetic regions 701 and 702, which causes the earphone support 108 to be attracted to and retained against a portion of the earphone device 104. As such, the earphone support 108 can be secured to the earphone device 104.

Figure 7D:
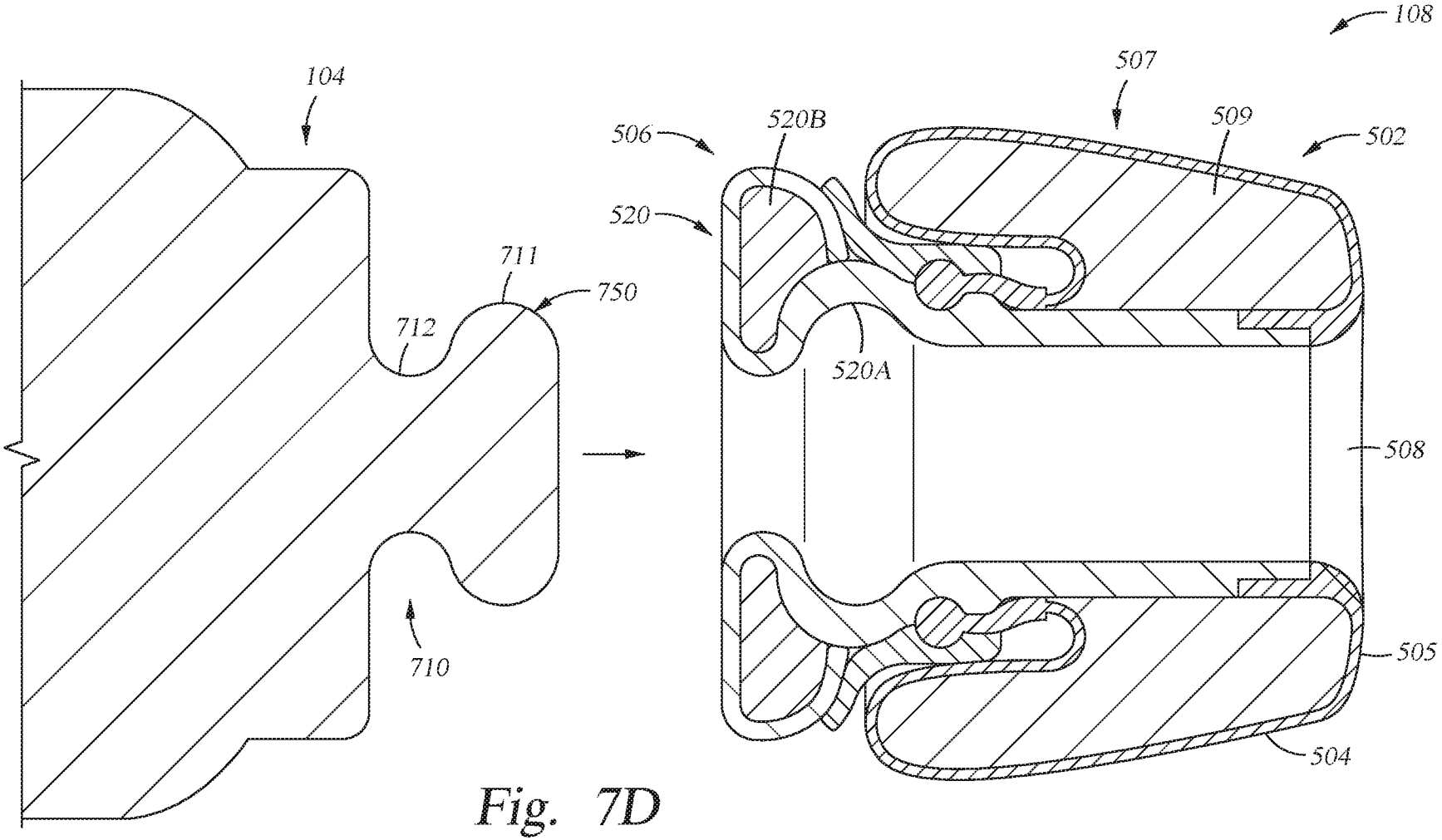
FIG. 7D is a sectional view of the earphone support and the earphone device, according to at least one embodiment described herein.

FIG. 7D is a cross-sectional view of an earphone support 108, which in some configurations, does not include or require a supporting element 510 to be reliably mounted on or be attached to an earphone device 104 due to the use of a retaining feature 750 formed therein. In this configuration, the earphone support 108 includes a flexible region 520 that is configured, in its pre-cured state, to be flexible enough to conform to the shape of features found in the retaining feature 750 of the earphone device 104. The retaining feature 750 can include a multifaceted region 710 that can be used as a mating feature that the engaging surfaces 520A of the flexible region 520 are configured to conform to, and be positioned against, when the earphone support 108 is positioned on the earphone device 104. As shown in FIG. 7D, the multifaceted region 710 can include a protruding portion 711 and a recessed portion 712. The flexible region 520 is configured to fit over the multifaceted region 710 of the retaining feature 750 of the earphone device 104. In some embodiments, the flexible region 520 is made of a material that is similar to the material used to form the sleeve 507 and have a thickness that allows this portion of the earphone support 108 to be flexible and/or moldable in its pre-cured state. The flexible region 520 can also include an internal region 520B that is configured to retain a curable filler material that is the same as or similar to the curable filler material 509 discussed herein. Prior to performing a curing process, the flexible region 520 can be positioned over a retaining feature 750 found on one of many different types of earphone devices 104 that each have a differently configured multifaceted region 710. Then, during the standard curing process performed on the earphone support 108, as described above, portions of the flexible region 520 can be simultaneously cured along with the other portions of the earphone support 108 that interface with the human ear 200 of a user (e.g., region(s) of the sleeve 507 containing the curable filler material 509). The process of curing the curable filler material 509 in the flexible region 520 will allow the shape of this portion of the earphone support 108 to be fixed, and thus allow the earphone support 108 to be fixedly attached to at least a portion of the retaining feature 750 after the curing process has been performed.

Figure 8:
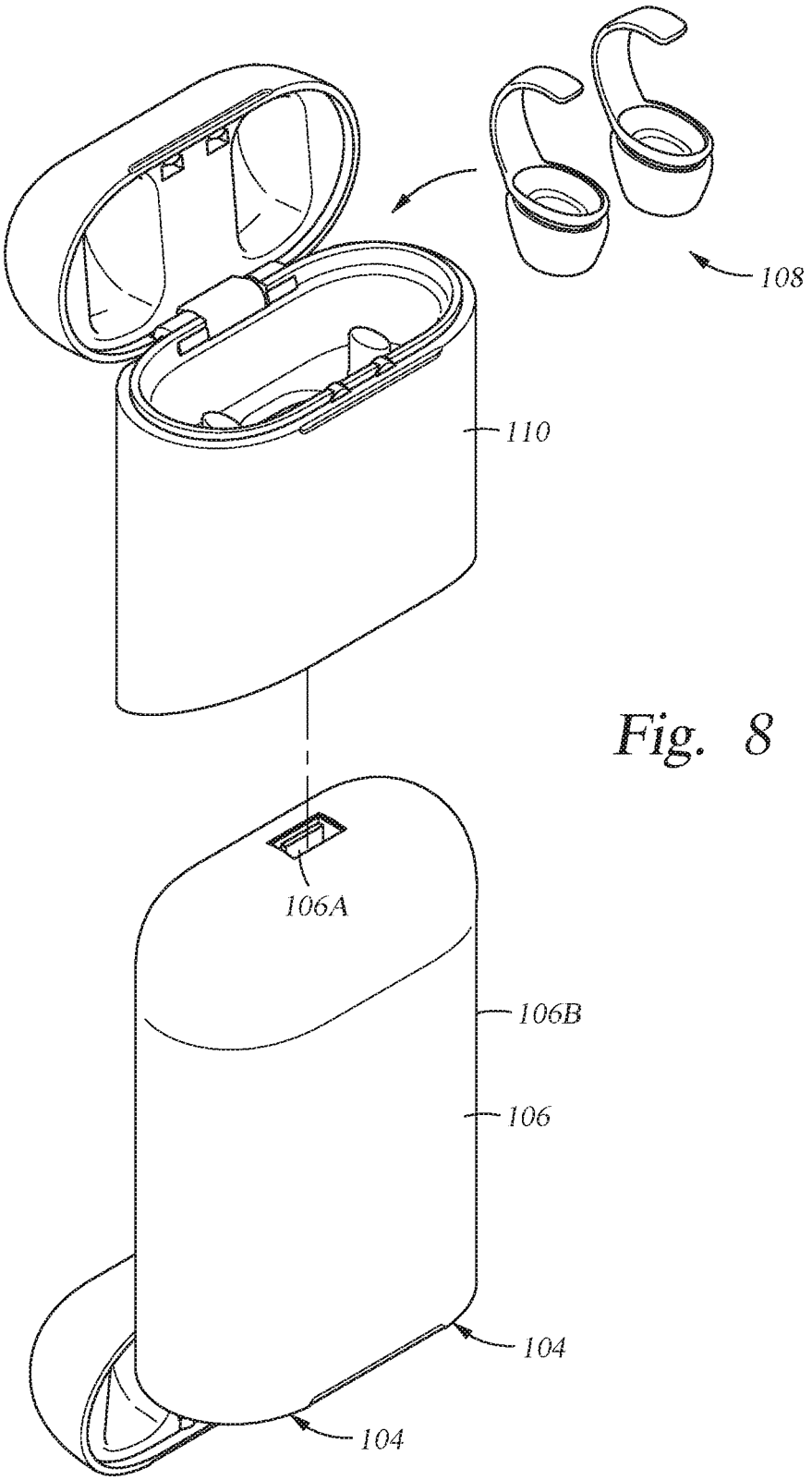
FIG. 8 is an exploded view of an earphone support case and an earphone device case, according to at least one embodiment described herein.

FIG. 8 is a perspective view of the earphone support case 110 separated from the earphone device case 106 and the earphone supports 108 according to at least one embodiment described herein. In these embodiments, the earphone supports 108 are configured to be securely stored within the earphone support case 110, which will be described further below. Additionally, the earphone support case 110 is configured to mate with the earphone device case 106, which will be described further below. The described configuration will result in a system where the earphone supports 108 and earphone devices 104 can be easily clipped onto and removed from each other and then be placed into each of their respective cases.

The earphone device case 106 includes the power delivery port 106A, which is located on one end of the case outer surface 106B. In some embodiments, the earphone device case 106 is inserted within the earphone support case 110 such that power delivery port 106A is proximate an aperture 919 (FIG. 9) within the earphone support case 110. Therefore, a user can charge the earphone device case 106 by placing a power cord through the aperture 919 and into the power delivery port 106A, advantageously allowing a user to easily charge the earphone device case 106 along with the earphone support case 110.

Figure 9:
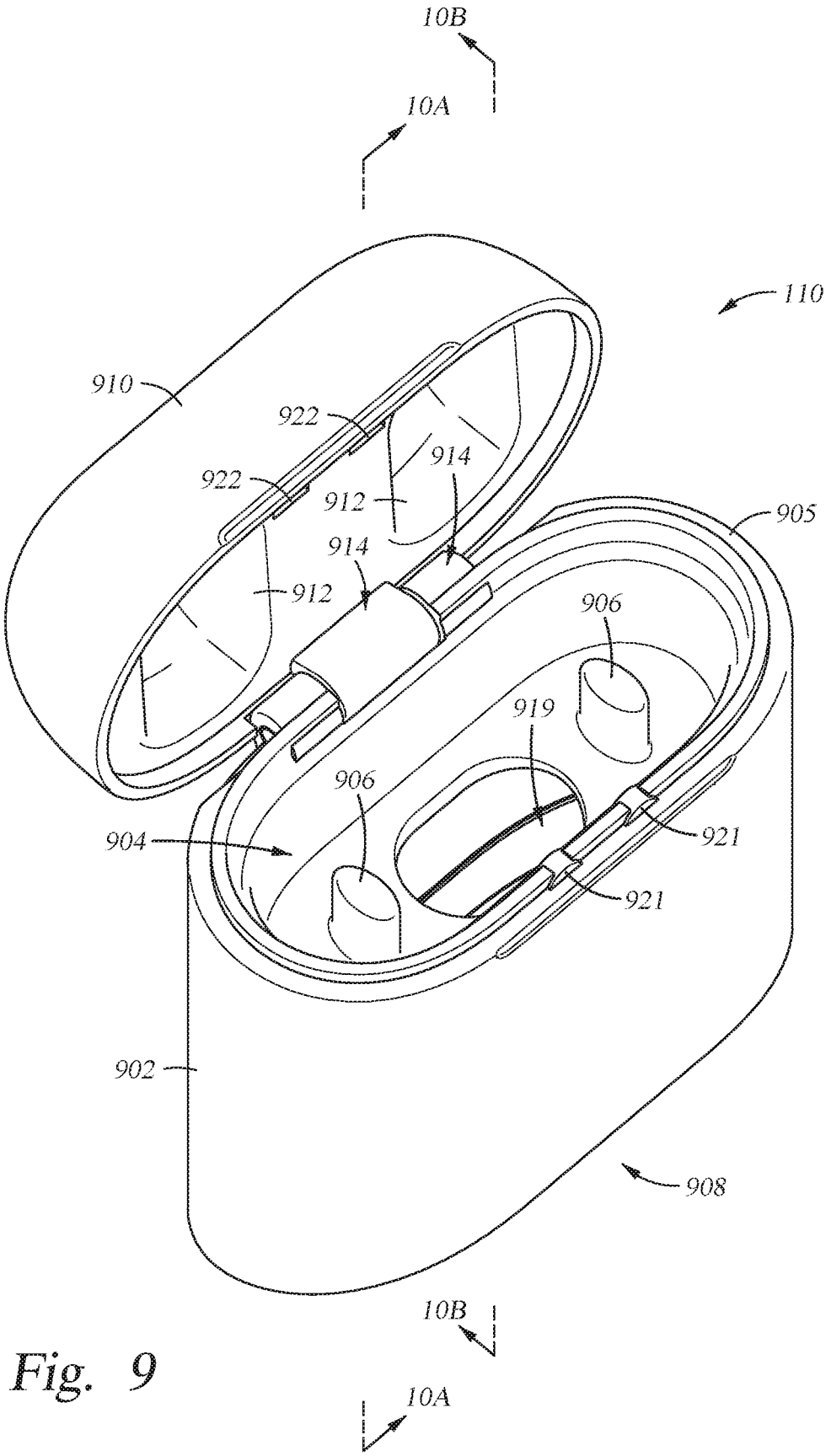
FIG. 9 is a perspective view of the earphone support case, according to at least one embodiment described herein.
Figure 10A:
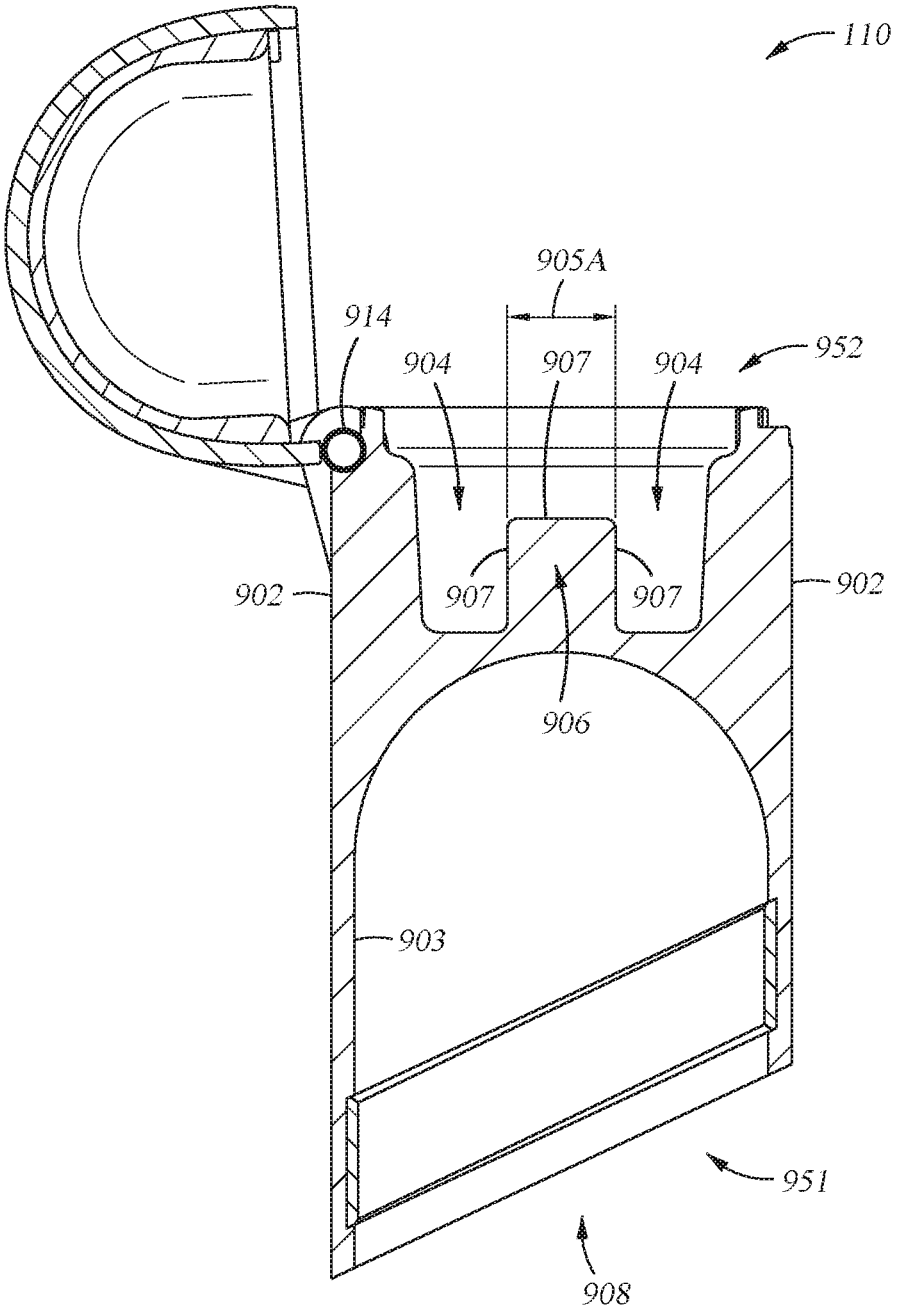
FIG. 10A is a cross-sectional view of the earphone support case, according to at least one embodiment described herein.
Figure 10B:
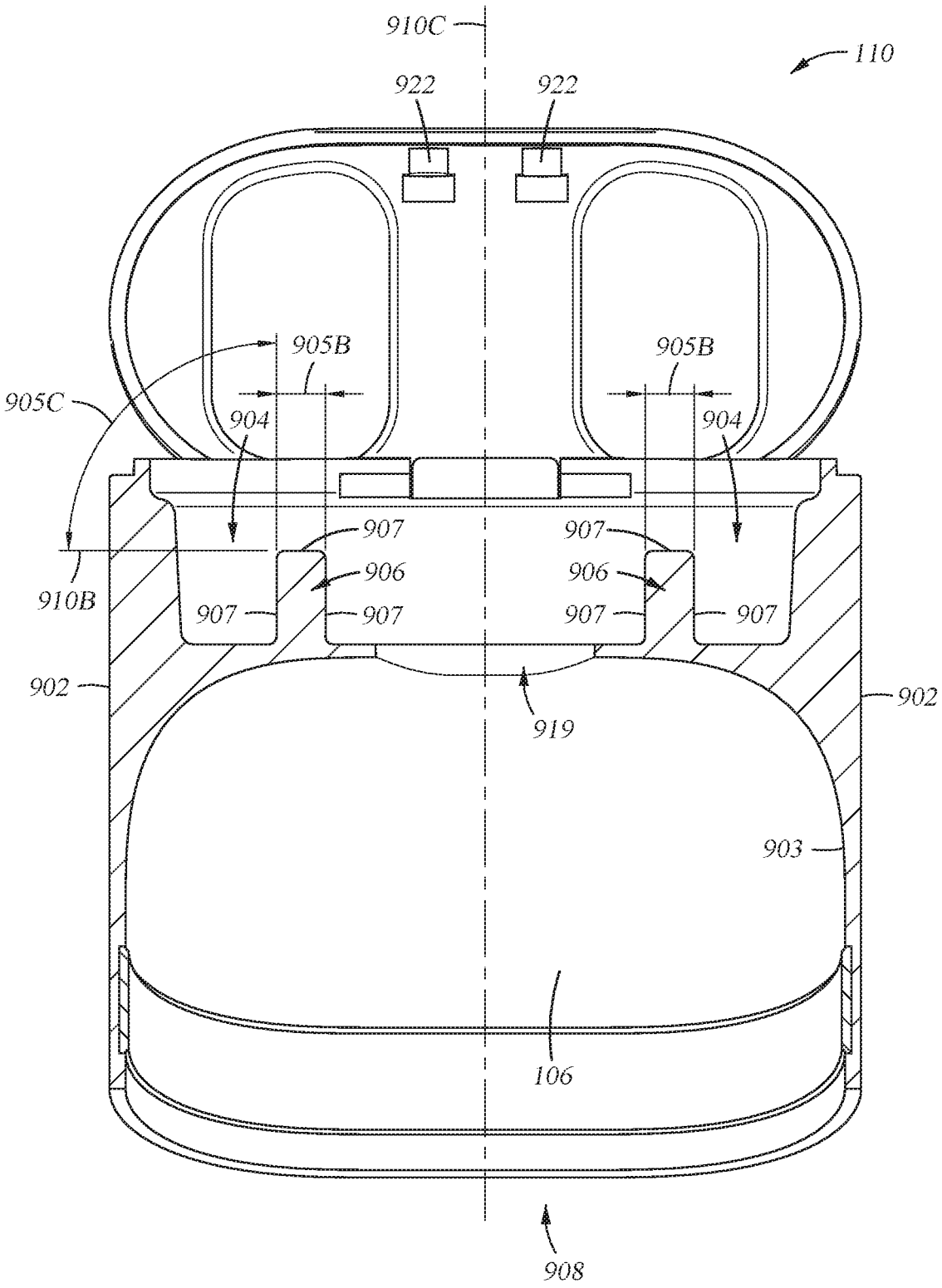
FIG. 10B is a cross-sectional view of the earphone support case, according to at least one embodiment described herein.
Figure 11A:
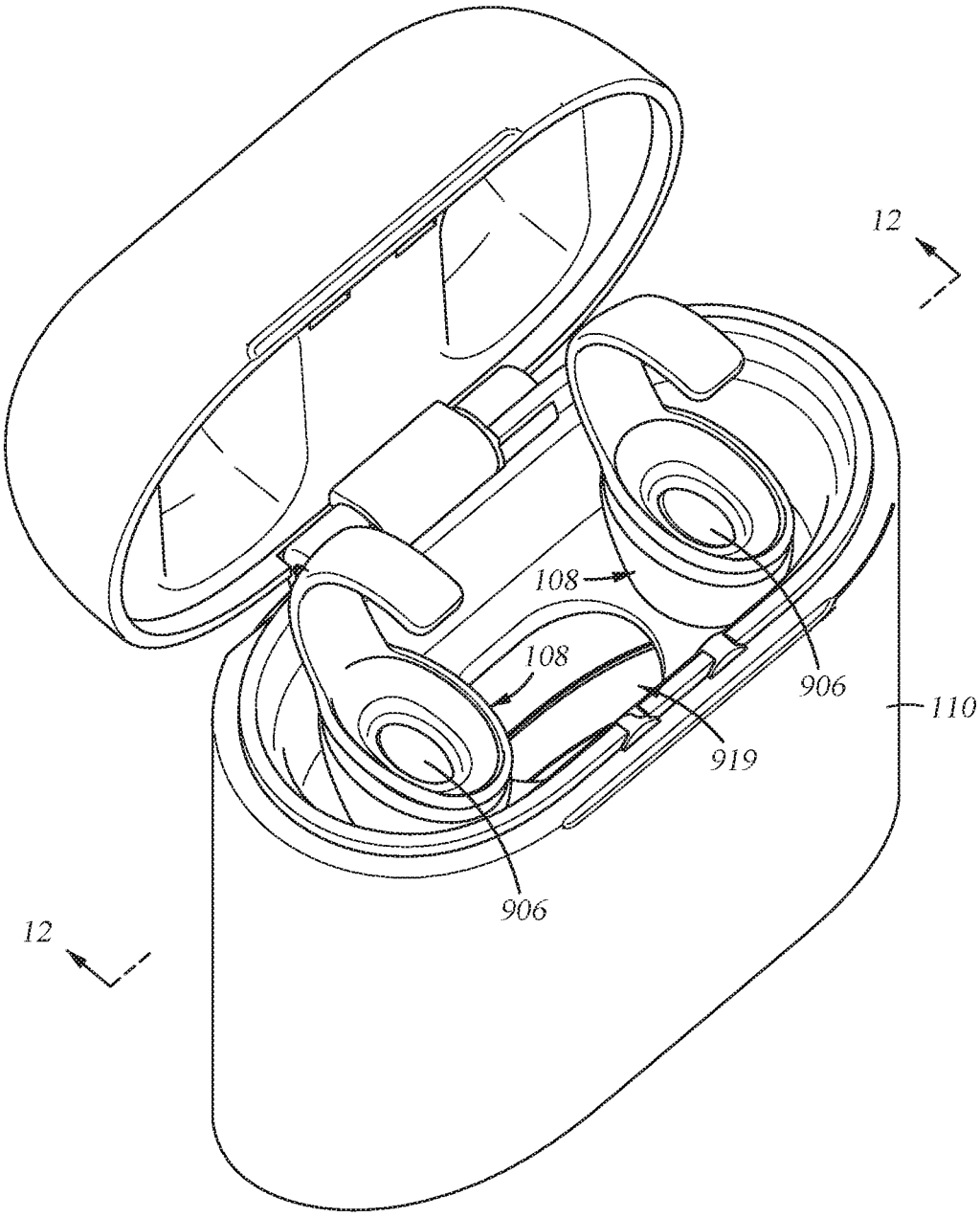
FIG. 11A is a perspective view of the earphone supports positioned on earphone support mounts within the earphone support case, according to at least one embodiment described herein.
Figure 11B:
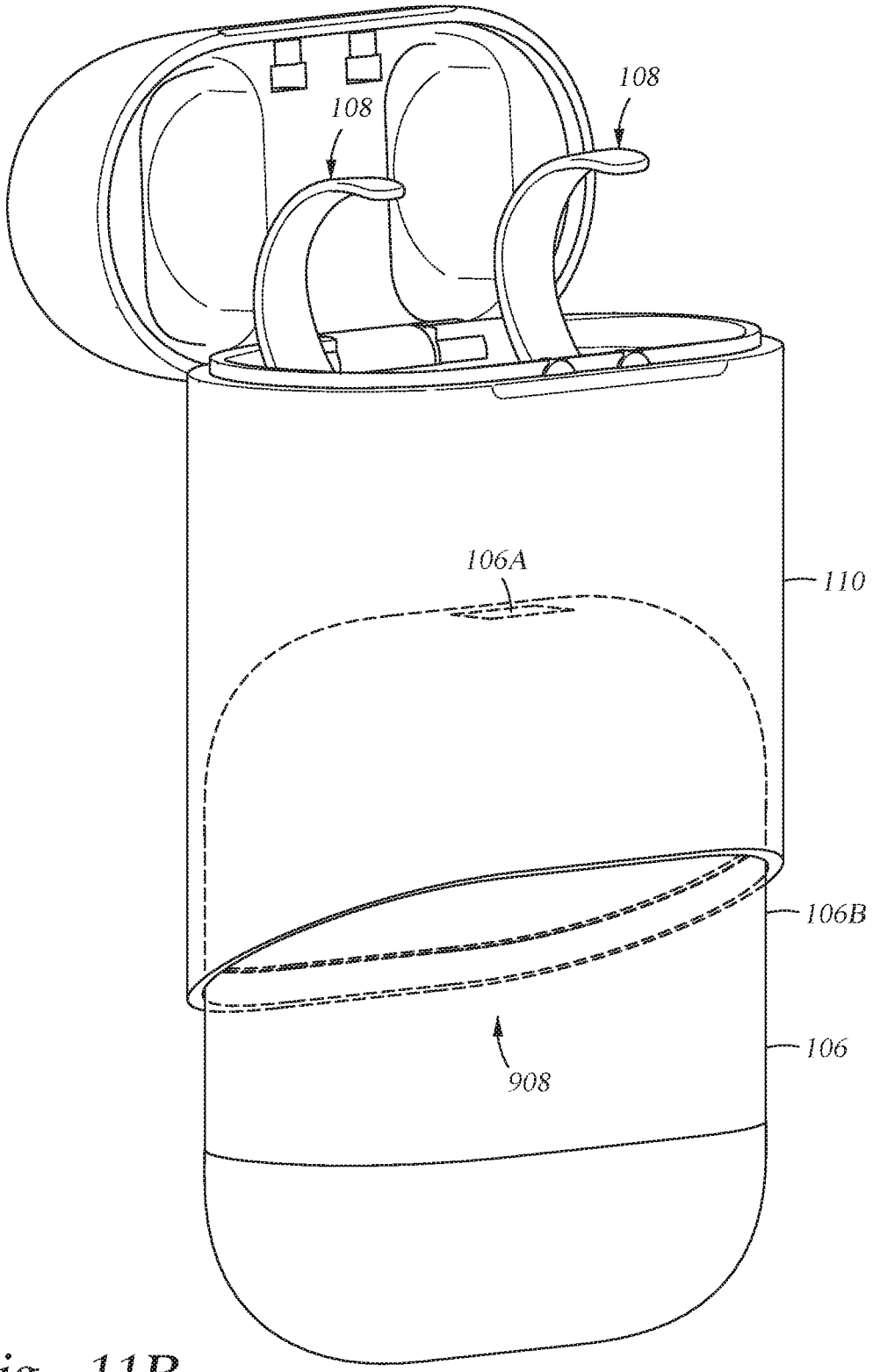
FIG. 11B is a perspective view of the earphone device case positioned on an earphone support case, according to at least one embodiment described herein.
Figure 12:
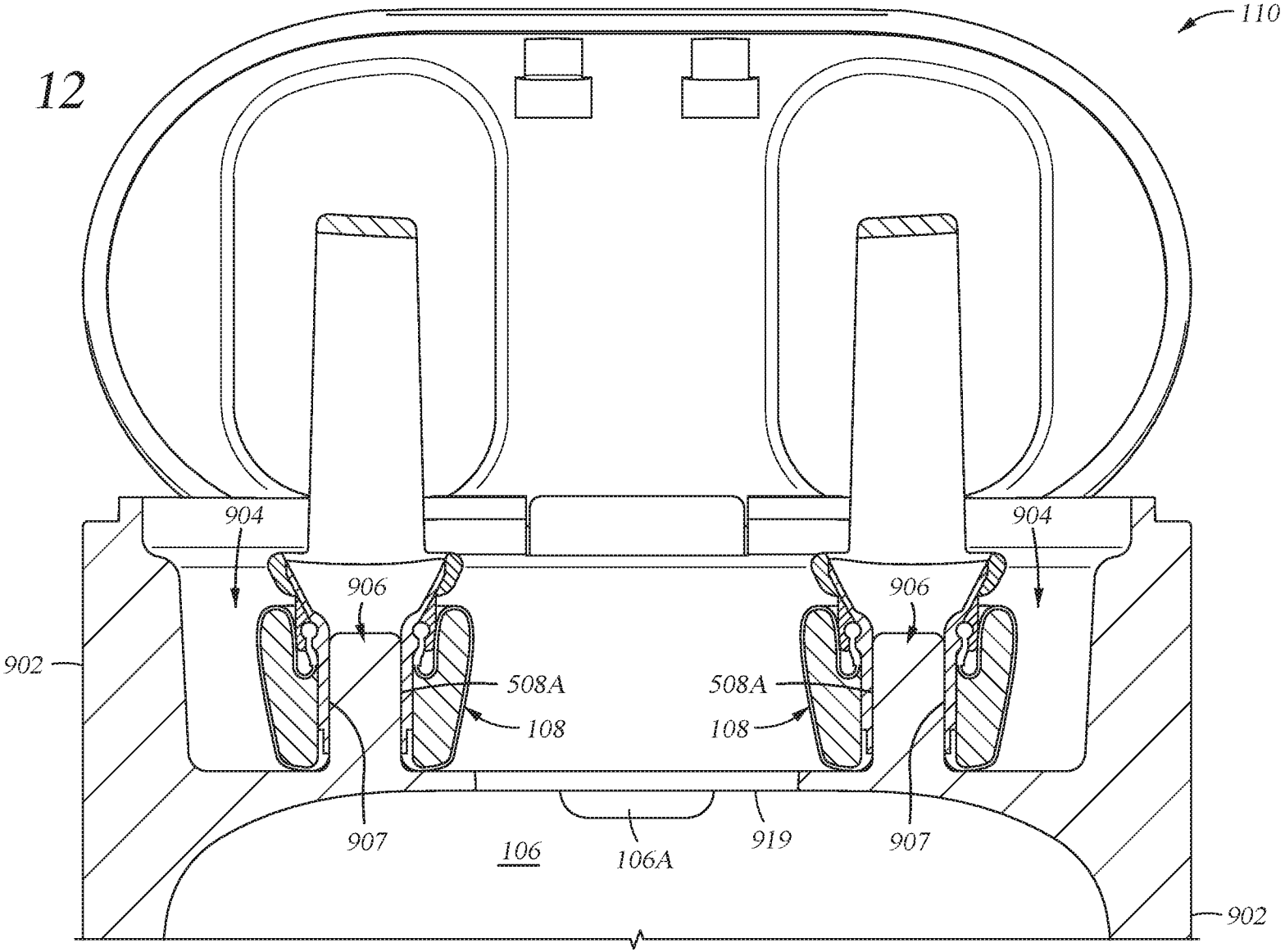
FIG. 12 is a cross-sectional view of the earphone supports positioned on the earphone support mounts of the earphone support case, according to at least one embodiment described herein.

FIG. 9 is a perspective view and FIGS. 10A-10B are sectional views of the earphone support case 110 according at least one embodiment described herein. FIG. 11A is a perspective view of the earphone supports 108 mounted onto earphone support mounts 906 of the earphone support case 110 according to at least one embodiment described herein. FIG. 11B is a perspective view of the earphone support case 110 mated with the earphone device case 106 according to at least one embodiment described herein. FIG. 12 is a sectional view of the earphone supports 108 mounted onto the earphone support mounts 906 according to at least one embodiment described herein. As illustrated in FIGS. 9-12, the earphone support case 110 includes a case body 902. The case body 902 includes a receiving area 904 proximate a first end 952 of the case body 902 and an open end 908 proximate a second end 951, which is opposite the first end 952. The receiving area 904 includes a plurality of earphone support mounts 906. Each of the earphone support mounts 906 is configured to support one of a plurality of earphone supports 108 (FIG. 11A). Each of the plurality of earphone supports 108 is configured to fit onto one of the earphone support mounts 906 (FIG. 12). In some configurations, the sound tube inner surface 508A of the sound delivery tube 508 is configured to fit over the support mount surface 907 of the earphone support mounts 906. The earphone support mounts 906 have a length 905A and a width 905B. In these embodiments, each of the sound tube inner surfaces 508A of the sound delivery tubes 508 of the earphone supports 108 has a small enough diameter such that they have an interference fit with the length 905A and the width 905B of the support mount surfaces 907 of the support mounts 906. Therefore, if a user presses softly on the main bodies 502 of the earphone supports 108, the sound delivery tubes 508 of the earphone supports 108 will be secured to the earphone support mounts 906. In some embodiments, the shape of the support mount surfaces 907 of the support mounts 906 includes features that help retain the earphone supports 108. In one example, the support mount surfaces 907 are shaped like the multifaceted region 710 described above in conjunction with FIG. 7D.

Additionally, the interference fit of the sound delivery tubes 508 onto the earphone support mounts 906 are such that the earphone supports 108 can be removed from the earphone support case 110 with low or moderate amount of force required by the user. In this configuration, the interference fit is used to create a retaining force that is generated between a surface of the earphone support mounts 906 and a surface of the earphone supports 108. As such, these embodiments provide an easy and convenient way to support and store the earphone supports 108 when they are not being used. The low to moderate amount of force required to position and remove the earphone supports 108 from the earphone support mounts 906 can allow the earphone supports 108 to be efficiently separated from an earphone device 104. Thus, a user can easily remove the earphone supports 108 from the earphone devices 104 and store the earphone supports 108 within the earphone support case 110. Furthermore, the user can easily remove the earphone supports 108 from the earphone support case 110 and secure the earphone supports 108 to the earphone device 104.

In some embodiments, the support mount surfaces 907 of the support mounts 906 can have a support mount angle 905C such that the earphone supports 108 can be inserted onto the support mounts 906 at an angle relative to a horizontal plane 910B (FIG. 10B) of the earphone support case 110. In some embodiments, the support mount surfaces 907 can have a support mount angle 905C that is set at an acute angle (not shown in FIG. 10B) relative to a central axis 910C of the earphone support case 110.

The open end 908 of the earphone support case 110 is configured to mate with the earphone device case 106 such that cases are secured together and can be easily carried around and stored together. Therefore, a user can easily access both the earphone supports 108 stored inside the earphone support case 110 and the earphone devices 104 stored inside the earphone device case 106. Thereafter, a user can easily position the earphone supports 108 onto the earphone devices 104 as described above. The case body 902 includes a case body inner surface 903. The case body inner surface 903 is configured such that there is an interference fit between the earphone device case 106 and the case body inner surface 903 when the earphone device case 106 is inserted onto the case body 902 of the earphone support case 110.

The earphone support case 110 also includes a lid 910. The lid 910 is coupled to the case body 902 by a hinge 914. The hinge 914 acts to allow the lid 910 to move between an open state and a closed state when a force is applied to the earphone support case 110 by a user. When the lid 910 is in the closed state, the end of the lid 910 fits over an end of the case body 902 such that the lid 910 covers the receiving area 904 and encloses the earphone supports 108. Further, the lid 910 includes apertures 912. When the lid 910 is in the closed state, the apertures 912 fit over the earphone support mounts 906 such that they each separately enclose an earphone support 108, including the supporting elements 510 of the earphone supports 108. When the lid 910 is in the open state, the lid 910 does not cover the receiving area 904, exposing the earphone supports 108 such that they can be easily removed by the user.

Additionally, in some embodiments, the lid 910 includes first magnets 922. The first magnets 922 are configured to attract to second magnets 921 located on an edge 905 of the case body 902. As such, when the hinge 914 acts to cause the lid 910 to be biased towards the closed state, the first magnets 922 magnetically couple to the second magnets 921 to help bring the earphone support case 110 to the closed state. Additionally, when coupled together, the first magnets 922 and the second magnets 921 act to keep the earphone support case 110 in the closed state, requiring some amount of force to cause the lid 910 to be moved to the open state.

Figure 13B:
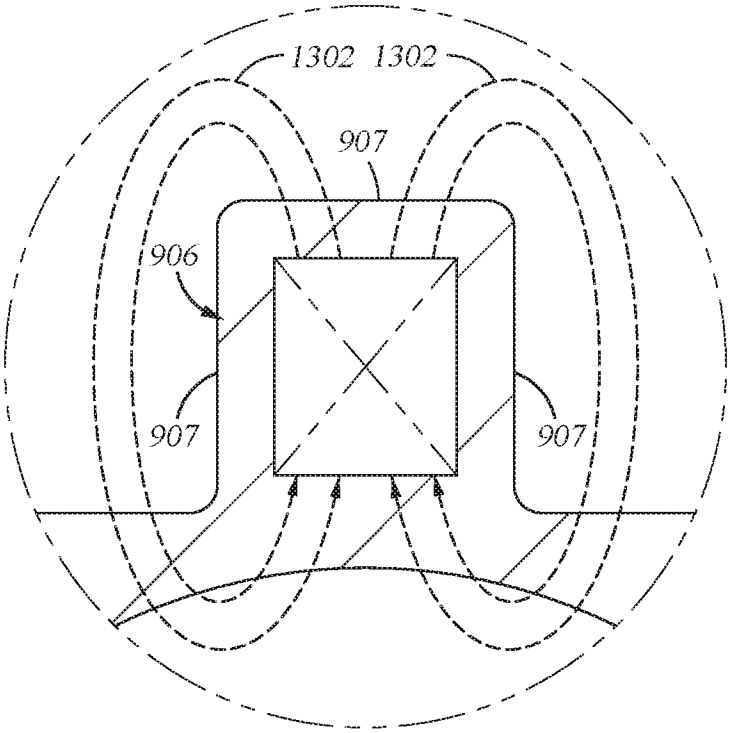
FIG. 13B is a close up sectional view of the earphone support case according to at least one embodiment described herein.
Figure 13A:
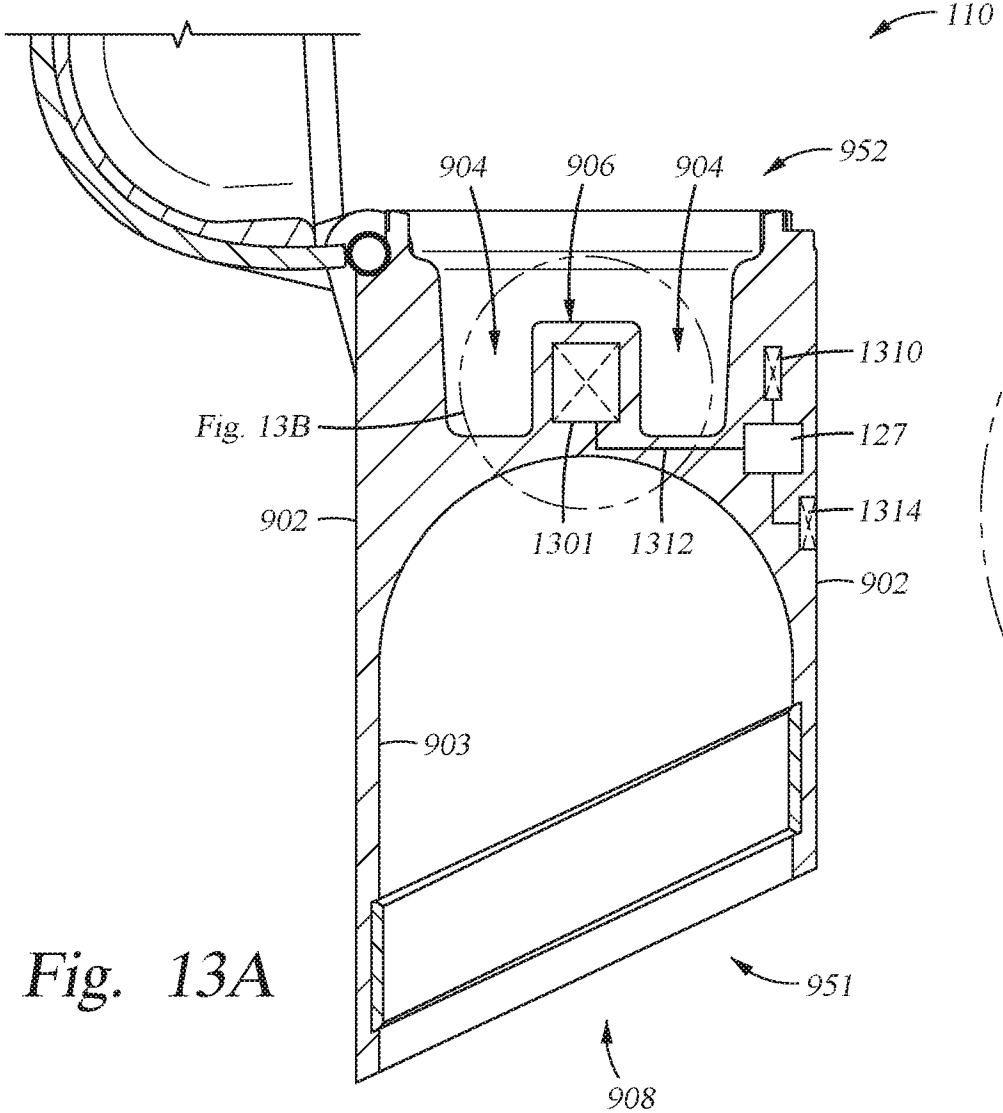
FIG. 13A is a sectional view of the earphone support case according to at least one embodiment described herein.

FIG. 13A is a sectional view and FIG. 13B is a close up sectional view of the earphone support case 110 according to at least one embodiment disclosed herein. As illustrated in FIG. 13A, the earphone support case 110 includes a magnetic field generating device 1301 that is positioned within the support mount 906 so that the magnetic field generating device 1301 can be used to hold or retain the earphone support 108 in place over an earphone support mount 906 due to a magnetic field generated by the magnetic field generating device 1301. The magnetic field generated by the magnetic field generating device 1301 is used to create an attraction between a magnetic region 701 formed in earphone support 108 and the magnetic field generating device 1301. The generated magnetic field can thus be used to create a retention force that is used to hold or retain the earphone support 108 in place over an earphone support mount 906. In some embodiments, the magnetic field generating device 1301 can include a permanent magnet that is disposed within a portion of the case body 902 (e.g., support mount 906). In other embodiments, the magnetic field generating device 1301 can include a magnetic field generating device, such as an electromagnet assembly (e.g., wound coil and power supply (e.g., battery)) that is disposed within a portion of the case body 902. In other embodiments, the magnetic field generating device 1301 includes a ferromagnetic, ferrimagnetic or paramagnetic material.

In some embodiments, a sensor 1310, which is mounted in the case body 902, is configured to detect the presence of an earphone support 108 and/or the presence of an earphone device 104 by a relative change in a magnetic field 1302 generated by the magnetic field generating device 1301 or a magnetic field generating element (e.g., magnet) found in an earphone device 104. In some embodiments, the sensor 1310 (e.g., Hall effect sensor) detects the magnetic field 1302 from the magnetic field generating device 1301 and sends a signal to an embedded controller 127, via a communication link 1312, so that the controller 127 can make an adjustment to the magnetic field strength that the magnetic region 701 of earphone support 108 is exposed to at some moment in time. Therefore, by use of the sensor 1310 and magnetic field generating device 1301, a software algorithm stored in non-volatile memory and executed by a processor found within the controller 127 is configured to cause the magnetic field 1302 to have a first magnetic field strength at a surface 907 of a support mount 906 when an earphone supports 108 is positioned on the support mount 906 and is configured to cause the magnetic field 1302 to have a second magnetic field strength at the surface 907 when the earphone support 108 is separated from the support mount 906. In other embodiments, a button 1314 can be pressed by a user which configures the controller 127 to cause the magnetic field 1302 to change from a first magnetic field strength to second magnetic field strength, and vice versa. In some embodiments, the first magnetic field strength is greater than the second magnetic field strength to promote retention of the earphone support 108 when it is positioned on a surface of the earphone support case 110 and minimize energy loss by the magnetic field generating device 1301 during times when the earphone support 108 is not near the earphone support case 110. In some embodiments, the first magnetic field strength is less than the second magnetic field strength during times when it is desired to promote the capture of an untethered earphone support 108 by the generated second magnetic field strength, while still providing a sufficient retention force to the earphone support 108, by the generated first magnetic field strength, when it is positioned over or near a surface of the earphone support case 110. In some embodiments, a magnetic field is generated by the magnetic field generating device while the earphone support is positioned on or over a surface of a support mount, and the magnetic field generated by the magnetic field generating device is halted before or while the earphone support is being removed from the surface of the support mount.

In some embodiments, the controller 127 is configured to cause the magnetic field strength of the magnetic field 1302 to drop to zero or near zero when the earphone supports 108 are enclosed within a space formed between the lid 910 and the case body 902 when the lid is closed. In some configurations, a button 1314 or other device is able to disconnect the magnetic field generating portion of the magnetic field generating device 1301 (e.g., coil) and a power source (not shown) when the lid is placed in a closed position.

Figure 14:
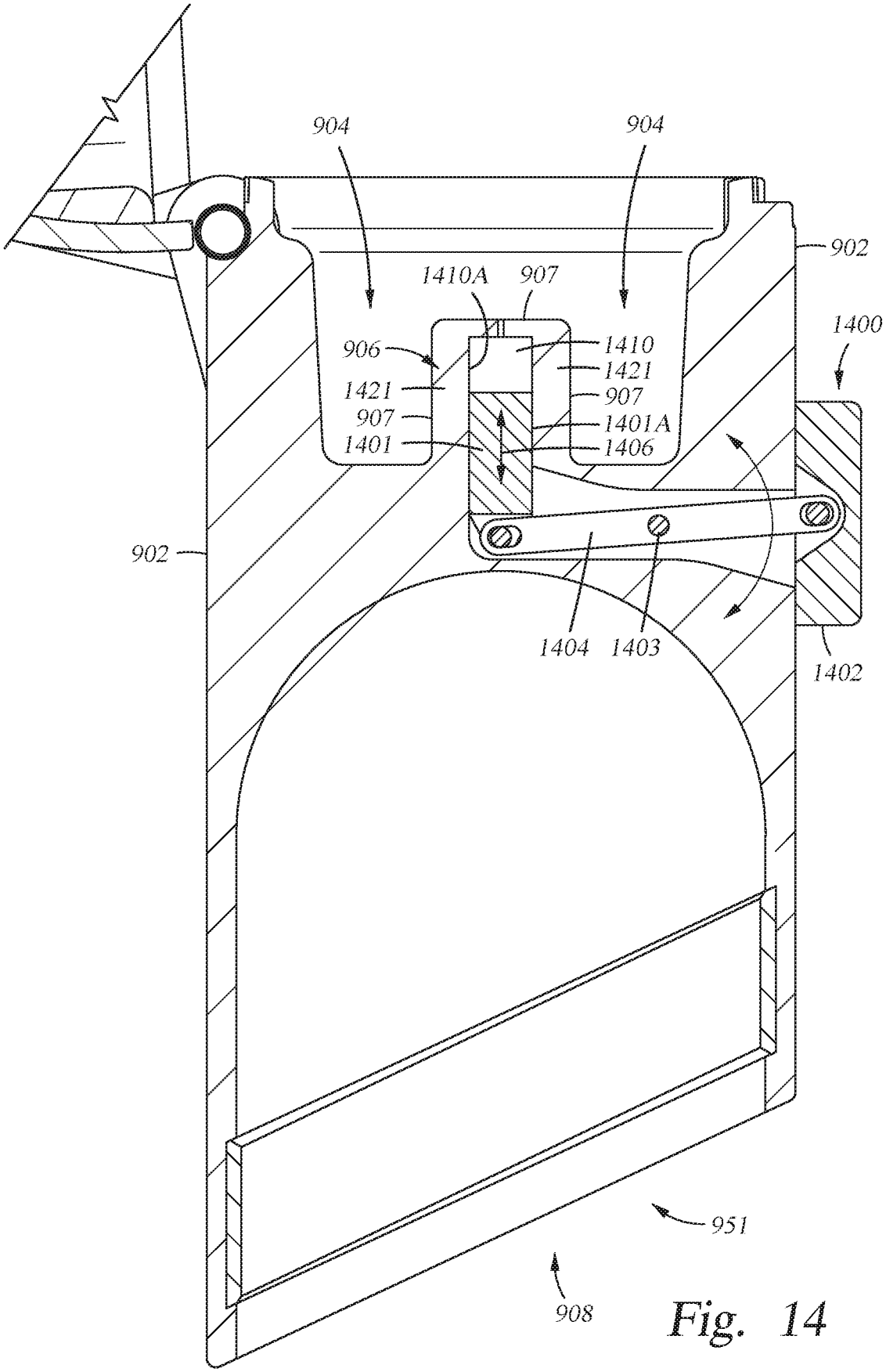
FIG. 14 is a sectional view of the earphone support case according to at least one embodiment described herein.

FIG. 14 is a sectional view of the earphone support case 110 that includes an actuating assembly 1400, according to at least one embodiment herein. In some embodiments of the earphone support case, a magnetic generating device 1401 of the actuating assembly 1400 is raised and lowered within a cavity 1410 within the support mount 906, as shown by arrow 1406 via a mechanical process. As shown in FIG. 14, the actuating assembly 1400 includes a button 1402, which is positioned on the case body 902, a lever 1404, fulcrum pin 1403 and the magnetic generating device 1401. The lever 1404 is coupled to the button 1402 at one end and is coupled to the magnetic generating device 1401 at the opposing end. When a user presses or repositions the button 1402, the lever 1404 and fulcrum pin 1403 are used to raise the magnetic generating device 1401 towards the top of the support mount 906, such that the magnetic field generated by the magnetic generating device 1401 can better secure an earphone support 108 thereon via a relative increase in magnetic field strength created by the repositioning of the magnetic generating device 1401 relative to a magnetic region 701 of earphone support 108. Additionally, when the user presses or repositions the button 1402 in another direction, or releases the button, the lever 1404 lowers the magnetic generating device 1401 away from the earphone support 108 and towards the bottom of the support mount 906 such that a user can more easily remove the earphone support 108 from the support mount 906, due to a relative decrease in magnetic field strength created between the magnetic generating device 1401 and the magnetic region 701 of earphone support 108. As similarly discussed above, in one example, the relative magnetic field strength that is used to hold or retain the earphone support 108 against a surface of the earphone support case 110 can be adjusted by positioning the magnetic generating device 1401 relative to a magnetic region 701 of the earphone support 108. In one example, a first magnetic field strength is achieved at a surface 907 of a support mount 906 by positioning the magnetic generating device 1401 relative to the surface 907 and a second magnetic field strength is achieved by repositioning the magnetic generating device 1401 relative to the surface 907 of the support mount 906. In one example, the first magnetic field strength is greater than the second magnetic field strength when the earphone support 108 is positioned on or over the surface 907 of a support mount 906. However, in another example, the first magnetic field strength is less than the second magnetic field strength to promote the capture of an untethered earphone support 108. As similarly discussed above, in another example, the first magnetic field strength is less than the second magnetic field strength to promote the capture of an untethered earphone support 108 while still providing retention of the earphone support 108 when it is positioned on a surface of the earphone support case 110.

In some embodiments, the actuating assembly 1400 is adapted, or further adapted from the configuration described above, to selectively provide mechanical retention of the earphone support 108 when it is positioned on or over the surface 907 of a support mount 906. In this configuration, the external surface 1401A of the magnetic generating device 1401 is shaped to cause the walls 1421 of the support mount 906 to flex so that external shape (e.g., diameter) of the surface 907 of the support mounts 906 changes as the position of the magnetic generating device 1401 within the cavity 1410 is altered by repositioning button 1402 and lever 1404. Thus, when the external shape of the surface 907 of the support mounts 906 becomes expanded, due to the position of the magnetic generating device 1401 within the cavity 1410 of the support mount 906, a force is applied to an adjacent portion of the earphone support 108, such that a retaining force is created between the surface 907 of the support mount 906 and an adjacent surface (e.g., sound tube inner surface 508A) of the earphone support 108. The walls 1421 of the support mount 906 are thinned, shaped and/or formed from a material (e.g., thermoplastic, elastomer, thin metal) that is adapted to flex and substantially return to its original shape after the magnetic generating device 1401 is inserted and then removed from a portion of the cavity 1410. In some embodiments, the external surface 1401A of the magnetic generating device 1401 has a wedge shape, a frustroconical shape, barrel shape, hourglass shape or other useful shape that causes the walls 1421 to flex as the magnetic generating device 1401 is moved within the cavity 1410. In some embodiments, the internal surface 1410A of the cavity 1410 is shaped to cause the walls 1421 to flex as the magnetic generating device 1401 is moved within the cavity 1410. In one example, during operation, a user presses or repositions the button 1402 which causes the magnetic generating device 1401 to move towards the top of the support mount 906, such that the external shape (e.g., diameter) of the surface 907 of the support mounts 906 increases to better secure an earphone support 108 to the support mount 906, due to the generation of the retaining force. Additionally, when the user presses or repositions the button 1402 in the opposing direction, the lever 1404 lowers the magnetic generating device 1401 away from the earphone support 108 and towards the bottom of the support mount 906 such that the external shape (e.g., diameter) of the surface 907 of the support mounts 906 decreases, and thus reduces the retaining force and allows the earphone support 108 to be removed from the support mount 906. One will appreciate that the "magnetic generating device 1401" in this configuration does not require the generation of a magnetic field to retain the earphone support 108 on the support mount, and thus the magnetic generating device 1401 in this case can be formed from any structurally viable material (e.g., metal, ceramic), and is alternately referred to herein as a mount shaping element.

Figure 15:
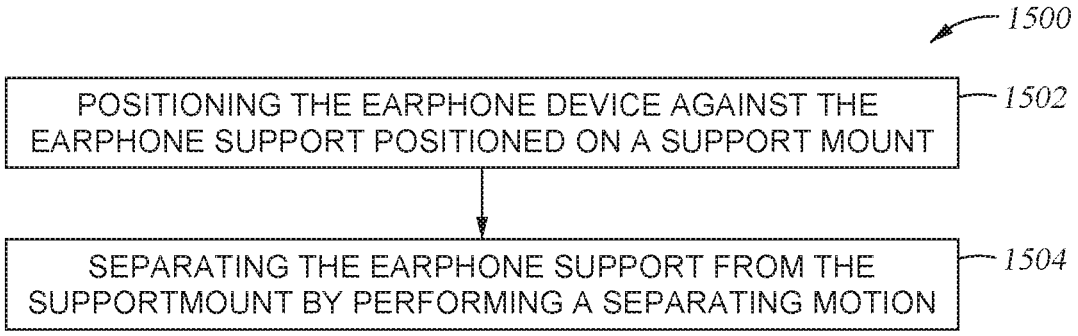
FIG. 15 is a flow chart of a method according to at least one embodiment herein.
Figure 16B:
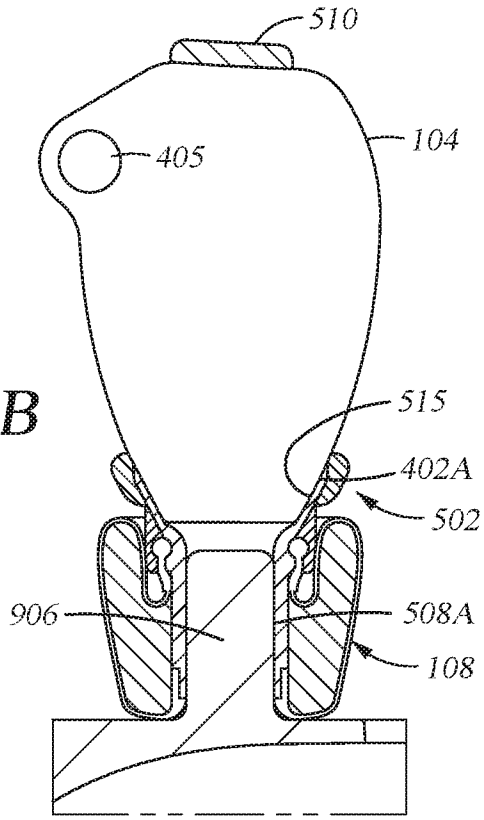
FIGS. 16A-16C are sectional views of an earphone device, earphone support and support mount that are used to illustrate portions of the method illustrated in FIG. 15.
Figure 16A:
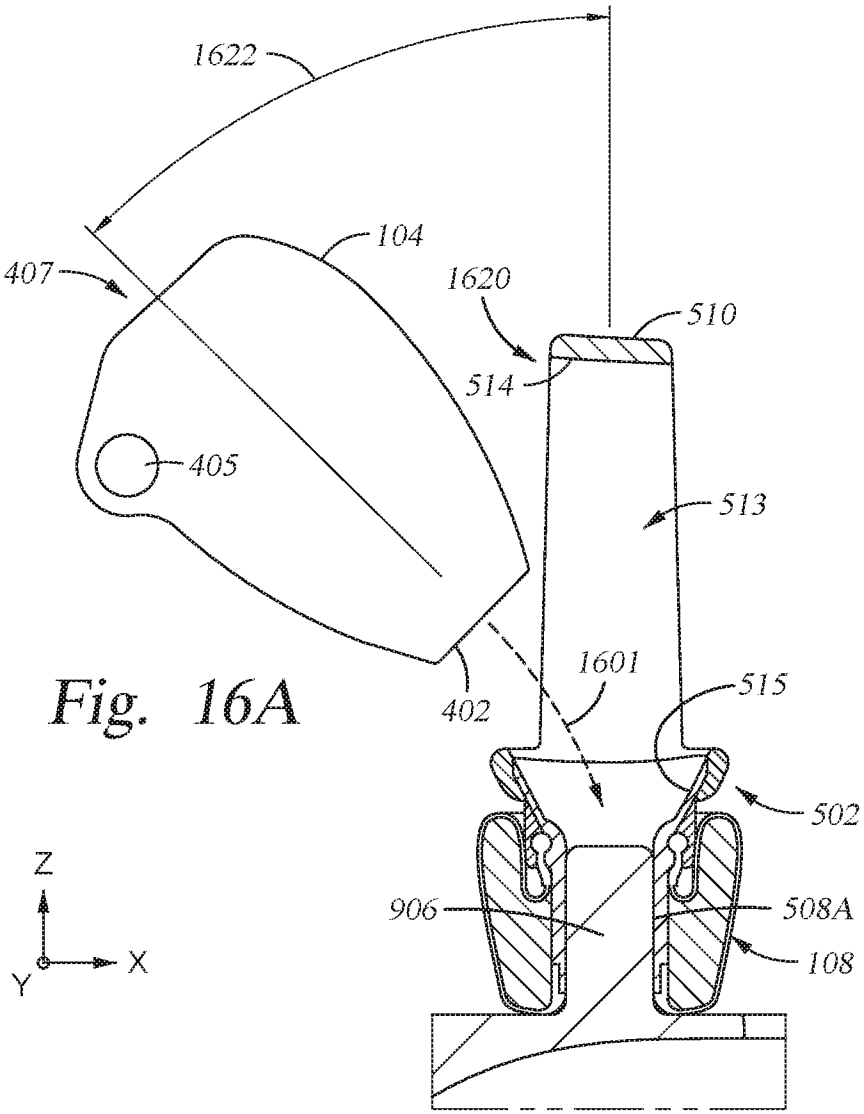
Figure 16D:
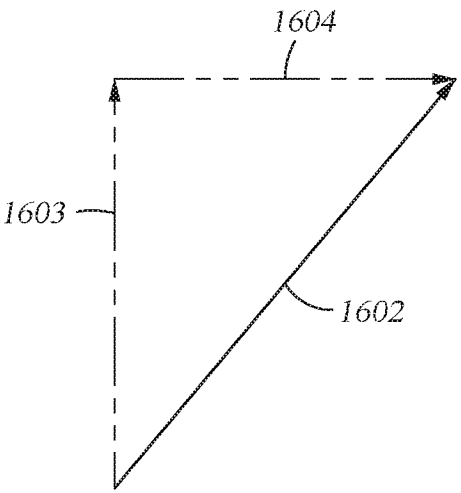
FIG. 16D illustrates components of a portion of the separating motion that are imparted to an earphone support during portions of the method described in FIG. 15.
Figure 16C:
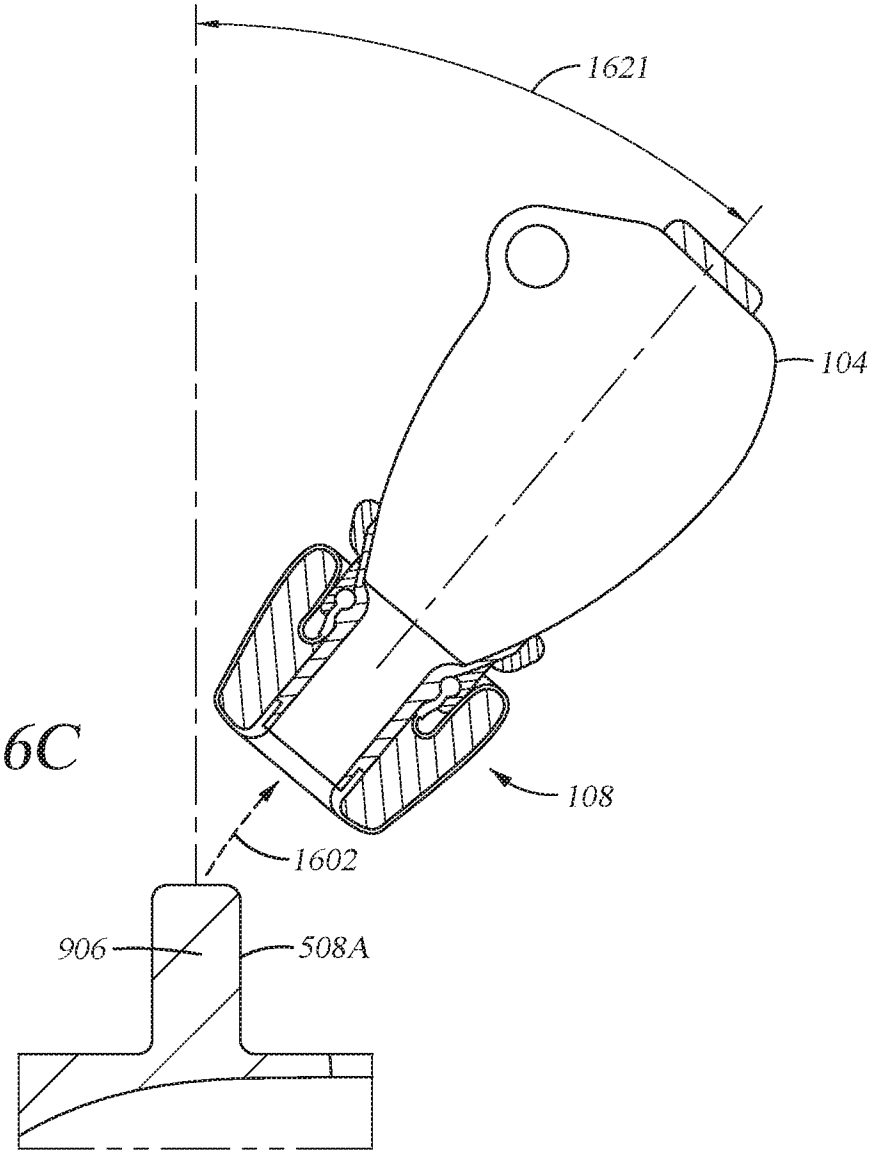

FIG. 15 is a flow chart that illustrates a method 1500 that is used to mount an earphone support 108 on an earphone device 104 when done in a forward sequential order, and unmount (or separate) an earphone support 108 from an earphone device 104 when done in a reverse sequential order, according to at least one embodiment described herein. Advantages of the method 1500 described herein include the ability of a user to mount and unmount an earphone support 108 relative to an earphone device 104 in an easy-to-perform single fluid motion using of one hand. In these embodiments, the method 1500 is performed with any of the systems and devices described in FIGS. 1-14, but is not limited to these systems and devices and can be performed with other similar systems and devices. FIGS. 16A-16C are provided to help illustrate some of the actions applied to an earphone device 104 and an earphone support 108 to complete the method 1500. FIG. 16D illustrates components of a portion of the separating motion that are imparted to the earphone support 108 during the performance of the method 1500.

In block 1502, the earphone device 104 is moved so that it is positioned against a portion of the earphone support 108, which is positioned on the support mount 906. In general, at the completion of the process(es) performed in block 1502 the earphone support 108 is positioned on or over a portion of the earphone device 104, which is referred to herein as a "mounted position" (FIG. 16B). In one example, the motions performed during block 1502 can be performed by a user gripping and moving the grip portion 405 of the earphone device 104 to cause the earphone device to be positioned in the "mounted position." Referring to FIG. 16A, during block 1502, an earphone device 104 is moved from a first position (see FIG. 16A) on a first side 1620 of the earphone support 108 to a second position (see FIG. 16B) within the device retaining region 513 of the earphone support 108, while the earphone support 108 is positioned on the support mount 906. The motion of the earphone device 104 will generally include a twisting or rolling motion (e.g., rotation of the earphone device 104 about the Y-axis) such that the earphone device 104 is captured within the device retaining region 513 and is disposed between the inner mounting surface 515 of the main body 502 and the inner surface 514 of the supporting element 510. The twisting or rolling motion is generally illustrated by path 1601 along which the earphone device 104 is moved during block 1502, as shown in FIG. 16A. The motion that follows a path 1601 will typically cause the orientation of the earphone device 104 to be altered by an angular orientation shift, such as represented by angle 1622 in FIG. 16A.

In some embodiments, at the completion of the process(es) performed in block 1502, the surface 402A of the earphone device 104 is disposed against the inner mounting surface 515 and the surface 404A of the earphone device 104 is in contact with the surface 514 of the supporting element 510. The shape and structure of the supporting element 510, in some embodiments, is configured to create a "clicking" or "snapping" action during block 1502, due to the creation of the holding force applied by the supporting element 510 and inner mounting surface 515 to the earphone device 104 from the act of positioning the earphone device 104 in the device retaining region 513.

In block 1504, the earphone support 108 and earphone device 104 are separated from the support mount 906 by performing a separating motion. Referring to FIGS. 16B and 16C, during block 1504, the earphone device 104 and the mounted earphone support 108 are moved from the mounted position (FIG. 16B) to a "separated position" (FIG. 16C). In one example, the separating motion can be performed as a user continues to grip and move the grip portion 405 of the earphone device 104 from the mounted position to the "separated position" (FIG. 16C) by continuing the motions performed during block 1502. The motion of the earphone device 104 and mounted earphone support 108 together will generally include a combined twisting or rolling motion (e.g., rotation of the earphone device 104 and earphone support 108 about the Y-axis) such that the earphone device 104 and mounted earphone support 108 remain coupled together and are detached from the support mount 906.

As shown in FIGS. 16C and 16D, the separating motion includes a motion that follows a path 1602 that has at least two component movements that can be completed simultaneously or in steps that are partially overlapping or staggered in time. In one example, as illustrated in FIG. 16D, the motion illustrated by path 1602 includes a vertical motion 1603 (e.g., Z-direction) and a horizontal motion 1604 (e.g., X-direction). In one example, the motion illustrated by path 1602 includes a "lifting action" in which a portion of the vertical motion 1603 is performed before the horizontal motion 1604 is imparted to the earphone device 104 and the mounted earphone support 108. In another example, the motion illustrated by path 1602 includes a "prying action" (or "prying motion") in which the horizontal motion 1604 is imparted to the earphone device 104 and the mounted earphone support 108 before the vertical motion 1603 is imparted to the earphone device 104 and the mounted earphone support 108. In some cases, the "prying action" can improve the ease with which the method 1500 is able to be performed using a single hand due to the initial prying action relative to the support mount 906, which is created by imparting the horizontal motion first. The separating motion that follows a path 1602 will typically cause the orientation of the earphone device 104 and mounted earphone support 108 to be altered by an angular orientation shift, such as represented by angle 1621 in FIG. 16C. The separating motion may comprise moving the earphone device and earphone support in a first direction and tilting the earphone device. In some embodiments, separating motion comprises moving the earphone device and earphone support in a first direction and tilting the earphone device a first angular distance (e.g., angle 1621), wherein tilting the earphone device includes rotating the earphone device an angular distance between about 1 and about 90 degrees, such as between about 5 and about 50 degrees.

As noted above, the process of unmounting an earphone support 108 from an earphone device 104 can be completed by performing the processes found in the method 1500 in a reverse sequential order. For example, during the unmounting process sequence, a reverse separating motion can be performed by a user moving the grip portion 405 of the earphone device 104 and earphone support 108 from the "separated position" to the "mounted position" by positioning the earphone device 104 and the mounted earphone support 108 on a support mount 906 by following path 1602 in reverse. Next, the earphone device 104 is separated from the earphone support 108 by a user moving the grip portion 405 of the earphone device 104 along the path 1601 in reverse.

As noted above, one or more of the advantages of the method 1500 include the ability of a user to mount and unmount earphone support 108 relative to an earphone device 104 in a single fluid motion using of one hand.

While the foregoing is directed to embodiments of the present disclosure, other and further embodiments of the disclosure may be devised without departing from the basic scope thereof, and the scope thereof is determined by the claims that follow.

The invention claimed is:

1. An earphone support, comprising:

a main body comprising:

an inner mounting surface;

a user interface surface; and a sound delivery tube extending through the main body between the user interface surface and the inner mounting surface, wherein the inner mounting surface is configured to be positioned over a sound emitting region of an earphone device so that a port within the sound emitting region of the earphone device is in fluid communication with the sound delivery tube, and the user interface surface is configured to extend at least partially into an ear canal of a user; and a supporting element extending from the main body, wherein a portion of the supporting element is shaped to follow a contour extending from a non-sound emitting region to the sound emitting region of the earphone device when the earphone device is positioned between the portion of the supporting element and the inner mounting surface, and the non-sound emitting region of the earphone device is on a side of the earphone device that is opposite to the sound emitting region.

2. The earphone support of claim 1, wherein the main body further comprises:

a sleeve portion having a surface that forms at least a portion of the user interface surface, and a curable filler material disposed within an enclosed region formed within the sleeve portion, wherein the sleeve portion and curable filler material comprise different materials.

3. The earphone support of claim 2, wherein, when the main body is positioned within a user's ear, the sleeve portion and the curable filler material are configured to conform to a shape of the user's ear.

4. The earphone support of claim 3, further comprising a curing assembly that comprises a light emitting diode (LED), wherein the LED is configured to emit a first wavelength of light that is configured to cure the curable filler material within the sleeve portion.

5. The earphone support of claim 4, wherein the first wavelength of light is between about 345 nm and about 490 nm.

6. The earphone support of claim 2, wherein the sleeve portion also forms at least a portion of the user interface surface, and a thickness of the sleeve portion at the inner mounting surface has a different thickness than a thickness of the sleeve portion at the sound delivery tube.

7. The earphone support of claim 1, wherein the supporting element further comprises a magnetic region, and the magnetic region is attracted to a magnetic region of the earphone device.

8. The earphone support of claim 2, wherein the sleeve portion comprises a sound blocking material that comprises a foam material.

9. An earphone support, comprising:

a main body comprising:

an inner mounting surface;

a user interface surface; and a sound delivery tube extending through the main body between the user interface surface and the inner mounting surface, wherein the inner mounting surface is configured to be positioned over a sound emitting region of an earphone device so that a port within the sound emitting region of the earphone device is in fluid communication with the sound delivery tube, and the user interface surface is configured to extend at least partially into an ear canal of a user; and a supporting element extending from the main body, wherein a portion of the supporting element is shaped to follow a contour extending from a non-sound emitting region to the sound emitting region of the earphone device when the earphone device is positioned between the portion of the supporting element and the inner mounting surface, the non-sound emitting region of the earphone device is on a side of the earphone device that is opposite to the sound emitting region of the earphone device, and the supporting element has a shape that is configured to generate a holding force that causes a portion of the inner mounting surface to be in intimate contact with a portion of the sound emitting region of the earphone device when the earphone device is positioned between the portion of the supporting element and the inner mounting surface.

10. The earphone support of claim 9, wherein the main body further comprises:

a sleeve portion that forms at least a portion of the user interface surface, and a curable filler material disposed within the sleeve portion, wherein the sleeve portion and curable filler material comprise different materials.

11. The earphone support of claim 10, wherein, when the main body is positioned within a user's ear, the sleeve portion and the curable filler material are configured to conform to a shape of the user's ear.

12. The earphone support of claim 11, further comprising a curing assembly that comprises a light emitting diode (LED), wherein the LED is configured to emit a first wavelength of light that is configured to cure the curable filler material within the sleeve portion.

13. The earphone support of claim 12, wherein the first wavelength of light is between about 345 nm and about 490 nm.

14. The earphone support of claim 9, wherein the earphone support further comprises a flexible region configured to fit over a retaining feature of the earphone device.

15. The earphone support of claim 10, wherein the sleeve portion comprises a sound blocking material that comprises a foam material.

16. An earphone support, comprising:

a main body comprising:

an inner mounting surface;

a user interface surface; and a sound delivery tube extending through the main body between the user interface surface and the inner mounting surface, wherein the inner mounting surface is configured to be positioned over a sound emitting region of an earphone device so that a port within the sound emitting region of the earphone device is in fluid communication with the sound delivery tube, and the user interface surface is configured to extend at least partially into an ear canal of a user; and a supporting element extending from the main body, wherein a portion of the supporting element has a curvature that is shaped to follow a contour of a non-sound emitting region of the earphone device when the earphone device is positioned between the portion of the supporting element and the inner mounting surface, the non-sound emitting region is on a side of the earphone device that is opposite to the sound emitting region; and a magnetic region attracted to a magnetic region of the earphone device via a magnetic field passing through the magnetic region of the earphone device when the earphone device is positioned between the portion of the supporting element and the inner mounting surface.

17. The earphone support of claim 16, wherein the main body further comprises:

a sleeve portion having a surface that forms at least a portion of the user interface surface, and a curable filler material disposed within an enclosed region formed within the sleeve portion, wherein the sleeve portion and curable filler material comprise different materials.

18. The earphone support of claim 17, wherein, when the main body is positioned within a user's ear, the sleeve portion and the curable filler material are configured to conform to a shape of the user's ear.

19. The earphone support of claim 18, further comprising a curing assembly that comprises a light emitting diode (LED), wherein the LED is configured to emit a first wavelength of light that is configured to cure the curable filler material within the sleeve portion.

20. The earphone support of claim 17, wherein the sleeve portion comprises a sound blocking material that comprises a foam material.

* * * * *